US008756766B2

(12) United States Patent
Zhang et al.

(10) Patent No.: US 8,756,766 B2
(45) Date of Patent: Jun. 24, 2014

(54) VIBRATION DAMPENING HANDLE FOR A POWERED APPARATUS

(71) Applicant: Black & Decker Inc., Newark, DE (US)

(72) Inventors: Qiang J. Zhang, Baltimore, MD (US); Daniel H. Sides, Jr., New Freedom, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 13/715,061

(22) Filed: Dec. 14, 2012

(65) Prior Publication Data

US 2013/0185899 A1 Jul. 25, 2013

Related U.S. Application Data

(63) Continuation-in-part of application No. 13/430,448, filed on Mar. 26, 2012, which is a continuation of application No. 12/723,243, filed on Mar. 12, 2010, now Pat. No. 8,141,209, which is a continuation of application No. 11/258,347, filed on Oct. 25, 2005, now Pat. No. 7,676,890.

(51) Int. Cl.
*B25G 1/10* (2006.01)
*B25D 17/04* (2006.01)

(52) U.S. Cl.
CPC ..... *B25D 17/043* (2013.01)
USPC ..... 16/431; 16/436; 16/421; 173/162.2

(58) Field of Classification Search
CPC ..... B25D 17/04; B25D 17/043; B25F 5/006; B25F 5/026
USPC ..... 16/431, 436, 421, DIG. 19, DIG. 12, 16/426; 81/489; 74/551.1, 543; 408/43; 279/7; 173/162.2, 162.1
See application file for complete search history.

(56) References Cited

U.S. PATENT DOCUMENTS

| | | | | | |
|---|---|---|---|---|---|
| 264,798 | A | * | 9/1882 | Tyler | 16/431 |
| 4,452,289 | A | * | 6/1984 | Smith | 81/177.1 |
| 4,611,671 | A | * | 9/1986 | Hansson | 173/162.2 |
| 4,660,832 | A | * | 4/1987 | Shomo | 16/431 |
| 4,820,090 | A | * | 4/1989 | Chen | 16/431 |
| 4,881,294 | A | * | 11/1989 | Riedl | 16/426 |
| 5,157,807 | A | * | 10/1992 | Keller et al. | 16/431 |
| 5,170,532 | A | * | 12/1992 | Holmin et al. | 16/431 |
| 5,273,120 | A | * | 12/1993 | Chang | 16/431 |
| 5,365,637 | A | * | 11/1994 | Bodell et al. | 16/431 |
| 5,740,586 | A | * | 4/1998 | Gomas | 16/430 |
| 5,769,174 | A | * | 6/1998 | Lee et al. | 173/162.2 |

(Continued)

*Primary Examiner* — Jeffrey O Brien

(74) *Attorney, Agent, or Firm* — Kofi Schulterbrandt; Scott B. Markow; Adan Ayala

(57) ABSTRACT

A vibration dampening handle for a powered apparatus includes an elongated gripping member having first and second opposite ends and a longitudinal axis extending through the first and second ends, and a wall defining an inner bore and having an inner surface. The inner bore extending along the longitudinal axis at least partially through the gripping member, and opens on at least the first end of the gripping member. A weighted mass is disposed at the second free cantilevered end of the gripping member. An elongate elastic beam member is attached to the gripping member. A portion of the beam member is disposed within the inner bore and is spaced apart from the inner surface. The beam member further includes a first end that extends beyond the first end of the gripping member and includes a fastening member adapted to connect the handle to the powered apparatus.

6 Claims, 23 Drawing Sheets

(56) References Cited

U.S. PATENT DOCUMENTS 6,497,007 B2 * 12/2002 Newman et al. ..... 16/427
6,595,300 B2 * 7/2003 Milbourne ..... 16/431
6,820,523 B1 * 11/2004 Chen ..... 81/177.2
2004/0016082 A1 * 1/2004 Yi ..... 16/421
2005/0087353 A1 * 4/2005 Oki et al. ..... 173/162.2
2008/0148524 A1 * 6/2008 Wiker et al. ..... 16/431
2008/0235913 A1 * 10/2008 Eicher et al. ..... 16/430

* cited by examiner $$\text{FREQUENCY} = \sqrt{\frac{k}{m}}$$

VIBRATION DAMPENING HANDLE FOR A POWERED APPARATUS

CROSS REFERENCE TO RELATED APPLICATION

This application is a continuation in part of U.S. patent application Ser. No. 13/430,448, filed on Mar. 26, 2012, which is a continuation of U.S. patent application Ser. No. 12/723,243, filed on Mar. 12, 2010 (now U.S. Pat. No. 8,141,209), which is a continuation from U.S. patent application Ser. No. 11/258,347 (now U.S. Pat. No. 7,676,890), filed on Oct. 25, 2005, all entitled Vibration Dampening Handle For A Powered Apparatus the entire disclosure of all applications being incorporated herein by reference.

BACKGROUND OF THE TECHNOLOGY

1. Field of Technology

The present disclosure relates to vibration dampening components, and more particularly relates to vibration dampening handles for powered apparatus. Such powered apparatus include, without limitation, example, powered woodworking and metal working tools and other power tools.

2. Description of the Background of the Technology

Power tools and other powered apparatus can generate substantial vibration during operation. Power tools, for example, may include reciprocating and/or rotating tool members such as bits, discs, and belts and, as such, vibration can be exacerbated when the tool member contacts a workpiece. One specific example of a power tool including a rotating part is a hand-held grinder, which includes a rotating abrasive disk. The grinder will generate a base level of vibration when the motor is engaged and the disk is rotating, and at least the magnitude vibration will increase when the abrasive disk contacts and is abrading a workpiece.

An objective of certain prior power tool designs has been to provide handles that dampen (i.e., reduce the magnitude of) vibrations and thereby transmit a reduced level of vibrations to the hand of an operator grasping the handle. Dampening vibrations increases operator comfort and reduces hand fatigue, allowing an operator to comfortable use the power tool for extended periods. Dampening vibrations also can improve an operator's control of the power tool, which can be especially important when doing fine work such as finish work on wooden workpieces.

Certain previous attempts to address the vibration problem have focused on including in the handle some type of vibration absorbing elastic element. U.S. Pat. No. 5,365,637, for example, discloses a vibration absorbing power tool including an elongated gripping member with first and second ends and an inner bore extending along a longitudinal axis of the gripping member and opening on the first end. An elongated support member, disposed in the inner bore, extends coaxially along the longitudinal axis. Means for mounting the gripping member to a power tool is mounted at the gripping member's first end and is spaced from an end of the support member. The gripping member, which is a monolithic elastomeric body, includes a region forming a radially extending flexible flange between the support member and the mounting means. The flexible flange permits the handle to flex in a direction generally transverse to the longitudinal axis, permits slight translation of the handle along the longitudinal axis, and absorbs some part of the vibration reaching the handle.

U.S. Pat. No. 5,273,120 discloses a vibration dampening handle for a power tool including an elongated handle housing having a longitudinal axis of symmetry and a first end. A bore extends into the housing along the longitudinal axis and opens on the first end. A support member is connected to the housing and is coaxial with the longitudinal axis and extends into the bore. A hollow tubular elastic flex member is telescoped over the support member, extends into the bore, and is affixed to both the handle housing and support member. A mounting surface on the tool includes an outwardly extending apex to which the support member is connected. The handle can rock back and forth over the apex as the flex member is flexed by vibrations from the tool.

U.S. Pat. No. 5,170,532 discloses a vibration dampening power tool handle including a hollow tubular member having a bell-shaped socket at a first end. A second end of the tubular member receives a stem portion of weighted mass, which is provided to reduce the handle's resonance frequency of the handle. The bell-shaped socket includes a circumferential groove formed on its inner periphery. A vibration insulating spring element, which may be a conical steel disc or membrane, is snapped into the circumferential groove. The spring element includes a central opening into which a mounting means may be disposed and connected to the power tool. Vibrational energy from the power tool is partially dissipated by the flexing motion of the spring element.

United States Patent Application Publication No. US 2004/0016082 A1 discloses a vibration absorbing power tool handle including a hollow tubular gripping member having first and second ends and an inner bore therethrough along a longitudinal axis of the gripping member. Two cylindrical elastic members having bores therethrough are disposed within the inner bore in a spaced apart relation near the first end of the gripping member. A rigid connecting member is disposed through and connected within the bores of the elastic members so that the connecting member can translate to some degree relative to the gripping member. An end of the connecting member extends beyond the first end of the gripping member and is connected to the power tool. The rigid connecting member acts to stiffen the handle, while the elastic members couple the gripping member to the connecting member and also absorb vibration transmitted from the power tool.

Certain other prior art power tool handle designs incorporate elements channeling the vibratory movement of the handle into less problematic translational modes. U.S. Pat. No. 5,769,174, for example, discloses a vibration dampening handle including a hollow space in which first and second base members are disposed. A surface of the first base member is parallel in an "x" direction and opposes a surface of the second base member, and the two base members are spaced apart in a "z" direction perpendicular to the "x" direction. Two parallel elongate flexible (elastic) beam members are connected to and span the "z" distance between the opposed base member's surfaces. The first base member may move within the handle in a "y" direction that is perpendicular to the "x" and "z" directions, but the first base member is restrained from moving in the "x" and "z" directions. This arrangement channels a portion of the vibratory loading on the handle to the "y" direction, and little angular deflection of the beam members occurs in the "x" and "z" directions. Accordingly, the handle is said to improve operator control by absorbing relative induced motion or vibration in one preferred direction, while retaining relative stiffness in the remaining two directions, and also by restraining the handle from torsional twist.

Despite the existence of the foregoing vibration dampening arrangements, there remains a need for innovative designs for power tool handles that reduce vibrations transmitted to the operator's hand. More generally, there remains a need for innovative handle designs that reduce transmitted vibration from other types of powered apparatus to an operator's hand.

SUMMARY

One aspect of the present disclosure is directed to a vibration dampening handle for a powered apparatus. The handle includes an elongate gripping member including a first end, a second end opposite the first end, a longitudinal axis extending through the first end and the second end, and a wall defining an inner bore and having an inner surface. The inner bore within the gripping member extends along the longitudinal axis at least partially through the gripping member and opens on at least the first end of the gripping member. The handle also includes a mass disposed at the second end of the gripping member. An elongate elastic beam member is one of attached to and integral with the gripping member. The beam member extends along a region of the longitudinal axis and includes a portion that is disposed within the inner bore and is spaced apart from the inner surface of the gripping member. The beam member further includes a first end that extends beyond the inner bore and the first end of the gripping member. The first end of the beam member includes a fastening member adapted to connect the handle to the powered apparatus. In certain embodiments of the vibration dampening handle, the first and, optionally, also the second natural frequencies of vibration of the beam member are less than a predetermined frequency of vibration of the powered apparatus.

An additional aspect of the present disclosure is directed to a handle for a power tool including a driven tool member, wherein the handle is capable of reducing transmitted vibration to the hand of an operator gripping the handle. The handle includes a gripping member that includes an elongate portion comprising a first end, a second end opposite the first end, and a wall that defines an inner bore and includes an inner surface. The inner bore extends along at least a portion of a longitudinal axis of the gripping member and opens on at least the first end of the gripping member. The handle also includes a mass disposed at the second end of the gripping member. An elongate elastic beam member is one of attached to and integral with the gripping member. The beam member extends along a region of the longitudinal axis, and at least a portion of the beam member is within the inner bore and spaced apart from the wall of the gripping member. At least a portion of a first end of the beam member extends beyond inner bore and the first end of the gripping member, and includes a fastening member to connect the handle to the power tool. In certain non-limiting embodiments of the power tool handle, the first and, optionally, also the second natural frequencies of vibration of the beam member are less than a predetermined frequency of vibration of the power tool.

A further aspect of the present disclosure is directed to a powered apparatus including a handle manipulated by an operator of the powered apparatus and which is adapted to dampen vibration generated by the apparatus. The handle comprises an elongate gripping member including a first end, a second end opposite the first end, a longitudinal axis extending through the first end and the second end, and a wall defining an inner bore and having an inner surface. The inner bore extends along the longitudinal axis at least partially through the gripping member and opens on at least the first end. The handle also includes a mass disposed at the second end of the gripping member. An elongate elastic beam member is attached to the gripping member and extends along a region of the longitudinal axis. At least a portion of the beam member is disposed within the inner bore and is spaced apart from the inner surface of the wall of the gripping member. The beam member includes a first end that extends beyond the first end of the gripping member. The first end includes a fastening member adapted to connect the handle to the powered apparatus. In certain embodiments of the powered apparatus, a predetermined frequency of vibration of the powered apparatus is higher than the first and, optionally, also the second natural frequencies of vibration of the beam member of the handle.

Yet another aspect of the present disclosure is directed to a power tool including a driven tool member and a vibration dampening handle for manipulating the power tool. The handle comprises a gripping member that includes an elongate gripping member including a first end, a second end opposite the first end, and a wall defining an inner bore and including an inner surface. The inner bore extends along at least a region of a longitudinal axis of the gripping member and opens on at least the first end of the gripping member. The handle also includes a mass disposed at the second end of the gripping member. An elongate elastic beam member is one of attached to and integral with the gripping member, and extends along a region of the longitudinal axis. At least a portion of the beam member is within the inner bore and is spaced apart from the wall of the gripping member. At least a portion of a first end of the beam member extends beyond the inner bore and the first end of the gripping member, and includes a fastening member to connect the handle to the power tool. In certain non-limiting embodiments of the power tool, the first and, optionally, also the second resonance natural frequencies of vibration of the beam member of the handle are lower than a predetermined frequency of vibration of the power tool. The predetermined frequency may be, for example, a frequency of vibration of the power tool when the driven tool member is under load.

BRIEF DESCRIPTION OF THE DRAWINGS

The features and advantages of the alloys and articles described herein may be better understood by reference to the accompanying drawing in which.

DESCRIPTION OF CERTAIN NON-LIMITING EMBODIMENTS

Other than in the operating examples, or where otherwise indicated, all numbers expressing dimensions, quantities of materials and the like used in the present description and claims are to be understood as being modified in all instances by the term "about". Accordingly, unless indicated to the contrary, any numerical parameters set forth in the following description and the attached claims are approximations that may vary depending upon the desired properties one seeks to obtain in articles according to the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the present disclosure are approximations, the numerical values set forth in any specific examples herein are reported as precisely as possible. Any numerical values, however, inherently contain certain errors, such as, for example, equipment and/or operator errors, necessarily resulting from the standard deviation found in their respective testing measurements. Also, it should be understood that any numerical range recited herein is intended to include the range boundaries and all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

Figure 1:
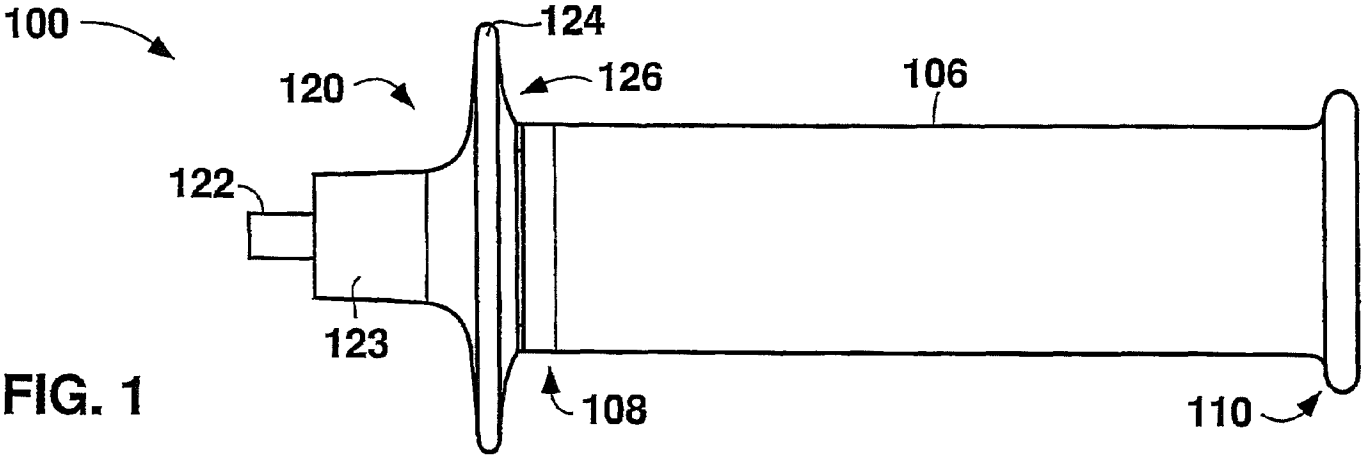
FIG. 1 is a plan view of a first embodiment of a vibration dampening handle constructed according to the present disclosure.
Figure 2:
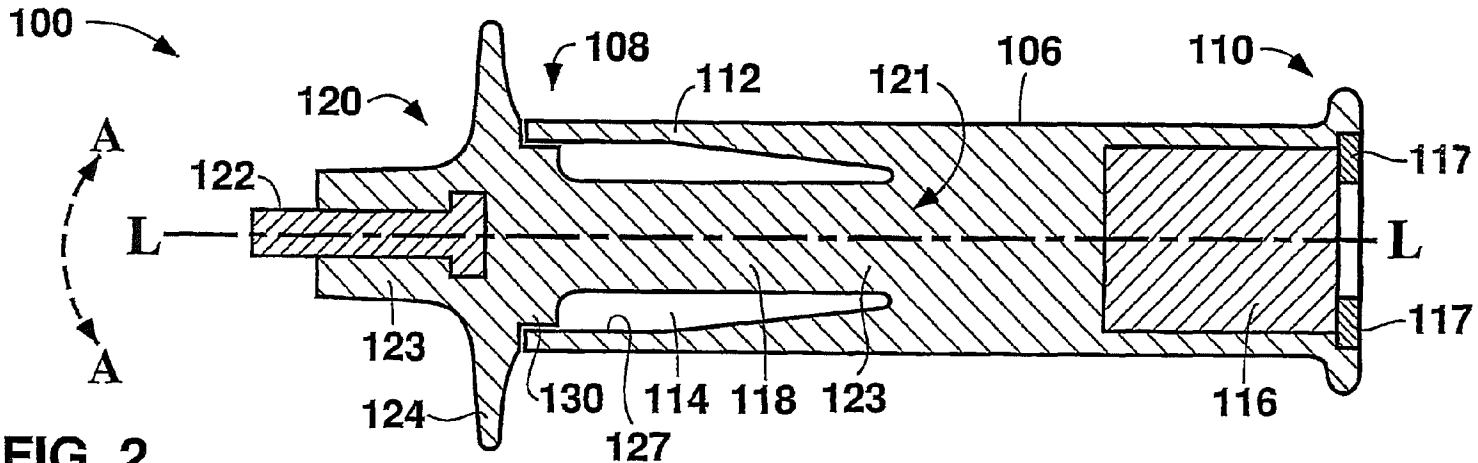
FIG. 2 is a cross-sectional view of the embodiment of FIG. 1, wherein the handle is sectioned through a longitudinal axis of the handle.
Figure 3:
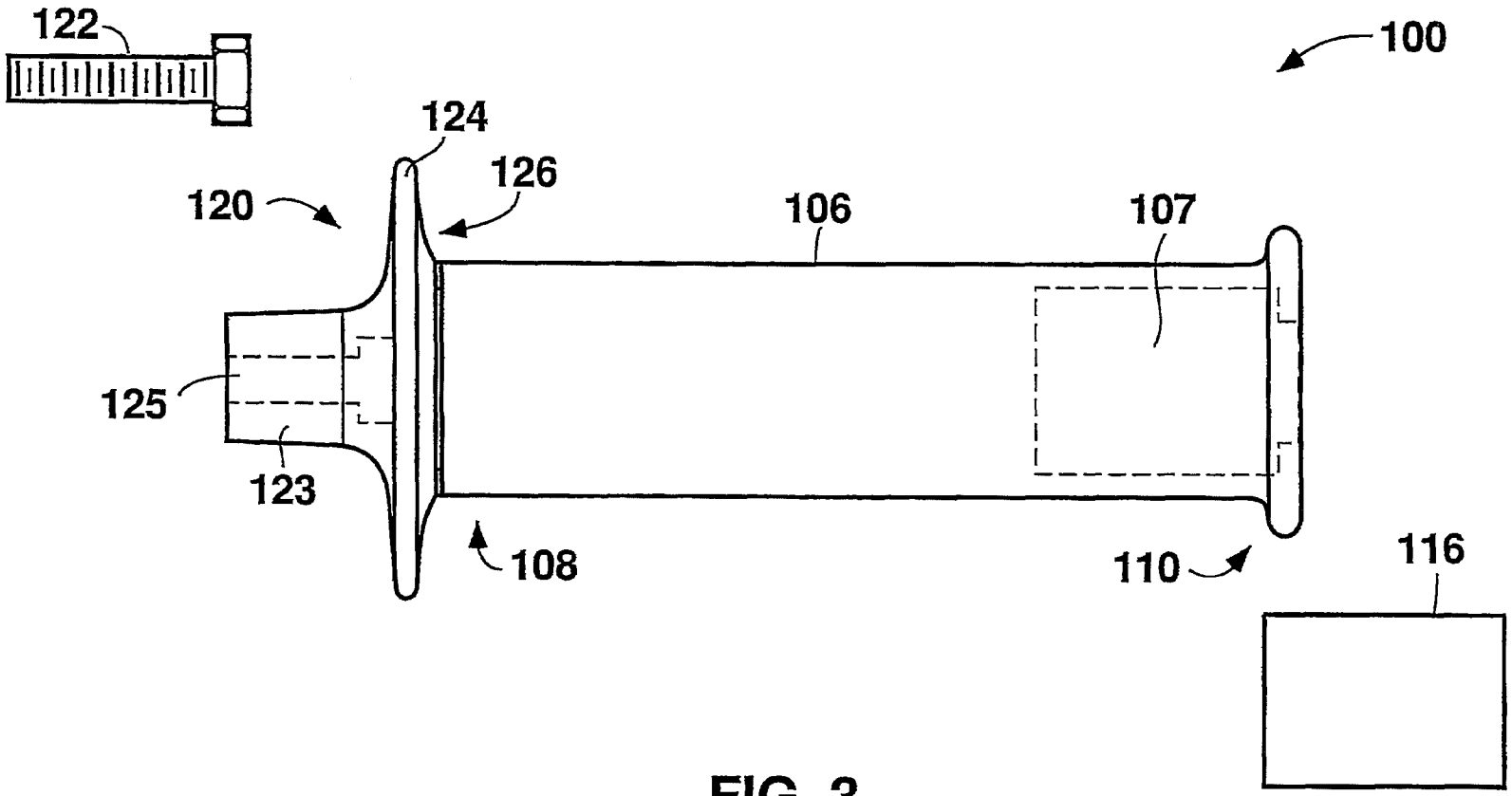
FIG. 3 is an assembly view depicting several component parts of the embodiment of FIG. 1.

FIGS. 1 through 3 schematically depict one embodiment of a vibration dampening handle according to the present disclosure. FIG. 2 is a cross section taken through a longitudinal axis of one non-limiting embodiment of a vibration dampening handle for a power tool or other powered apparatus according to the present disclosure. The vibration dampening handle 100 is designed so that it can inhibit the transmission of vibration from the powered apparatus during its operation to the hand of an operator gripping the handle. The handle includes an elongate gripping member 106 having a first end 108, an opposed second end 110, and a longitudinal axis L-L that intersects both the first end 108 and the second end 110. The gripping member 106 may be contoured or otherwise shaped so as to facilitate gripping by the hand of an operator of the powered apparatus. The gripping member 106 may be generally symmetrical or asymmetrical about the longitudinal axis. For example, the gripping member 106 may have a contour that is generally cylindrical, for example, symmetrical about the longitudinal axis L-L. Alternatively, the gripping member 106 may have a contour that is asymmetrical about the longitudinal axis L-L such as, for example, a handlebar grip-shaped contour providing specific contour features accommodating the positions of the operator's fingers. More generally, the gripping member 106 may have any shape suitable for manipulation by an operator of the powered apparatus and, preferably, such shape is comfortable and provides requisite control of the apparatus when gripped by the operator. In certain non-limiting embodiments of the handle 100, the gripping member 106 is constructed of a hard plastic such as, for example, acrylonitrile butadiene styrene (ABS), or any other suitably hard material using conventional manufacturing techniques such as, for example, blow or injection molding. Also, all or a portion of its outer peripheral surface of the gripping member 106 may be sheathed or otherwise covered with a resilient material (not shown in FIGS. 1 through 3) to improve grip comfort.

The gripping member 106 includes a peripheral wall 112 that defines an inner bore 114 within the gripping member 106. In certain non-limiting embodiments of the handle 100, and as shown on FIG. 1, the inner bore 114 extends within the gripping member 106 along at least a region of the longitudinal axis L-L. In certain other embodiments, the inner bore 114 may extend entirely through the gripping member 106, thereby opening on both the first end 108 and the second end of the gripping member 110. Alternatively, as shown in the embodiment 100 depicted in FIGS. 1 through 3, the inner bore 114 extends along the longitudinal axis L-L through only a portion of the length of the gripping member 106 and opens only on the first end 108 of the gripping member 106.

Handle 100 further includes a mass 116 (a weight) that is disposed at or near the second end 110 of the gripping member 106. A purpose of the mass 116 is to increase the weight of the gripping member 106 at or near the second end 110 and relative to the first end 108 of the gripping member 106. The mass 116 may be, for example, a metallic or ceramic member, or may be composed of any material having a density greater than the material from which the gripping member 106 is constructed. The gripping member 106 is designed so that the mass 116 may be disposed and securely retained in its position at or near the second end of the gripping member 106. This may be achieved by various means, including providing a cavity 107 at the second end 110 dimensioned to accept the mass 116 and retaining the mass 116 in the cavity using, for example, a cap 117 secured over the cavity or a fastener or a suitable adhesive that secures the mass 116 within the cavity 107. In an alternate arrangement not shown in FIGS. 1 through 3, the inner bore formed in the gripping member extends into the second end of the gripping member, and the mass is disposed within the inner bore at the second end and secured in that position. In yet another alternate arrangement, the gripping member is made from a plastic material, and the mass is molded within the second end of the gripping member during fabrication of the gripping member. The preferred arrangement for disposing the mass within the second end of the gripping member may be influenced by the relative costs associated with manufacturing the vibration dampening handle by the various options.

The vibration dampening capability of the handle 100 is facilitated by including in the handle 100 an elastic beam member 118 that is positioned within the inner bore 114. The elastic beam member 118 originates from the vicinity of the second end 110 of the gripping member 106 and extends generally along the longitudinal axis L-L to the first end 108 of the gripping member 106. A first end 120 of the beam member 118 extends beyond the first end 108 of the gripping member 106 and includes a fastening member 122 disposed in a cavity 125. The fastening member 122 is for connecting the handle 100 to the powered apparatus. The fastening member 122 is secured to collar 123 and may have any suitable form. For example, the fastening member 122 may be a threaded member. To secure the handle 100 to the powered apparatus, the collar 123 and fastening member 122, for example, may be secured within a bore in a housing of the powered apparatus. The first end 120 of the beam member 118 may have any suitable shape. For example, as suggested in FIG. 1, the first end 120 may include an annular radial projection 124 having a curved side region 126, which an operator's hand may abut when gripping the handle 100 and which limits the hand from contacting the surface of the powered apparatus housing to which the handle 100 is connected.

As shown in FIG. 2, a second end 123 of the beam member 118 is integral with the material from which the gripping member 106 is constructed in the region 121. As shown in connection with other possible embodiments described herein, however, one possible alternative arrangement is a handle design wherein the second end of the beam member is configured to mate with a region of the gripping member and thereby securely connect the members together. Thus, handle 100 differs from several of the other embodiments discussed below in that the gripping member 106 and the beam member 118 are an integral part (i.e., one piece). Accordingly, although the term "member" is used in the present description (and in the claims) in connection with the gripping member, the beam member, and the fastening member, such use does not preclude the possibility that two or more of the gripping member, the beam member, and the fastening member are portions or regions of a single integral part, or that a single "member" is comprised of two or more elements or parts assembled to provide the member. In relation to FIG. 3, for example, the second end 123 of the beam member 118 is integral with the gripping member 106.

As further shown in FIG. 2, a portion of the beam member 118 within the inner bore 114 is spaced away from an inner surface 127 of the wall of the gripping member 106. The beam member 118 is made of a material having elastic properties such as, for example, a plastic such as ABS. The beam member 118 and gripping member 106 are dimensioned and positioned so that, as suggested by curved line A-A, the beam member 118 may be elastically laterally deflected through a range of motion relative to the wall 112 of the gripping member 106. The propensity of the beam member 118 to move in response to an applied force may be adjusted by including a resilient material, such as a plastic or a rubber material, in all or a portion of the space 114 between the beam member 118 and the wall 112. Also, as shown in FIG. 2, annular shoulder 130 of first end 120 of the beam member 118 opposes and is spaced apart from wall 112 of the gripping member 106, and the remainder of first end 120 extends beyond the gripping member 106. As will be understood from FIG. 2, the range of deflection of the beam member 118 relative to the gripping member 106, indicated by the curved arrow A-A, is limited by the width of the gap provided between shoulder 130 and the inner wall 127.

Given that the first end 120 of the beam member is connected to the powered apparatus by fastening member 122, vibrations generated, for example, by the motor of the powered apparatus will be transmitted to the handle 100 and to the operator's hand. An objective of the present disclosure is to reduce the vibration experienced in this way by the operator. In that regard, a characteristic of the handle 100 is that the beam member 118 may be "tuned" so as to have predetermined natural or standing frequencies, or "modes", of vibration. The modes of vibration of the beam member 118 may be affected by adjusting parameters of handle 100 including: (1) the weight and position of the mass 116; (2) the shape (for example, circular cross-section, square cross-section, or beam with ribs) and dimensions (length, diameter, width) of the beam member 118; and (3) the material from which the beam member 118 is constructed. The stiffness characteristics of the beam member 118 are affected by, for example, material of construction, beam length, and beam member wall thickness (if the beam is hollow) or beam member diameter (if the beam is solid).

According to one aspect of the present disclosure, the first and, optionally, also the second natural frequencies of vibration of the beam member 118 of handle 100 are chosen (by appropriate selection of the foregoing parameters) to be less than a predetermined frequency of vibration of the powered apparatus. The mode shapes of the first and second natural frequencies of vibration impart a substantial amount of energy to the handle, and typically are the main contributors of handle vibration. Accordingly, handle vibration at those frequencies preferably are avoided. The predetermined frequency of vibration of the powered apparatus may be, for example, the frequency or frequency range of vibration of the powered apparatus under load. According to one non-limiting example, the powered apparatus is a power tool (such as a grinder) including a driven a tool member (a rotating abrasive disc), the predetermined frequency of vibration under load may be, for example, the typical frequency or frequency range at which the power tool vibrates when the driven tool member is contacting and imparting force to a workpiece. In another non-limiting example, the powered apparatus is an outboard engine for a boat including a throttle handle, and the predetermined frequency of vibration under load is that frequency or frequency range at which the motor typically vibrates when the throttle of the outboard engine is at the maximum setting. In yet another example, the powered apparatus is a vehicle (such as a motorcycle or a snowmobile), and the frequency of vibration under load is the frequency or frequency range at which the vehicle typically vibrates when the vehicle commonly will be driven.

By "tuning" the beam member with first and second natural frequencies of vibration that are less than a frequency or frequency range of vibration of the powered apparatus under load, much possible vibration of the handle is avoided. Those having ordinary skill may readily ascertain a desirable predetermined frequency or range of frequency of vibration of a powered apparatus under load (for example, a frequency commonly experienced during use of the apparatus), and may readily adjust the several relevant parameters discussed above so that the beam member of a handle constructed according to the present disclosure will have first and second natural frequencies of vibration that are less than the predetermined frequency or frequency range. In this way, embodiments of a handle according to the present disclosure, such as handle 100 in FIGS. 1 through 3, dampen vibrations transmitted to the handle 100 from the apparatus. Alternatively, the first and second natural frequencies of the beam member may be tuned so as to be less than a typical frequency or frequency range of vibration expected when the motor of the powered apparatus is running, but the apparatus is not under load. Another possible alternative is to adjust the design of the handle so that the first and second natural frequencies of the beam member are less the typical frequency or frequency range of vibration expected when the motor of the powered apparatus is running under load or is not running under load.

Figure 4:
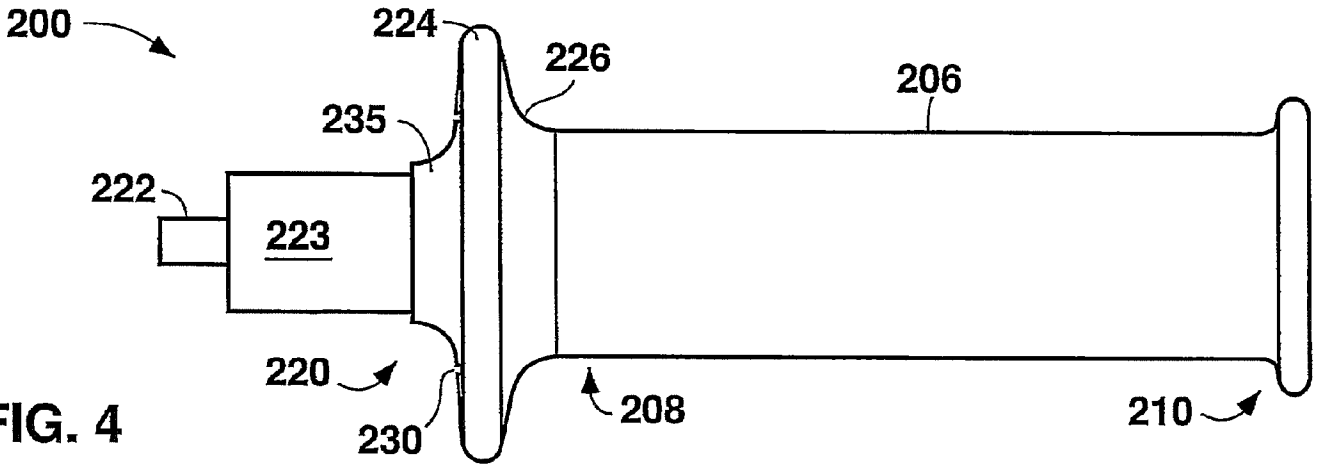
FIG. 4 is a plan view of a second embodiment of a vibration dampening handle constructed according to the present disclosure.
Figure 5:
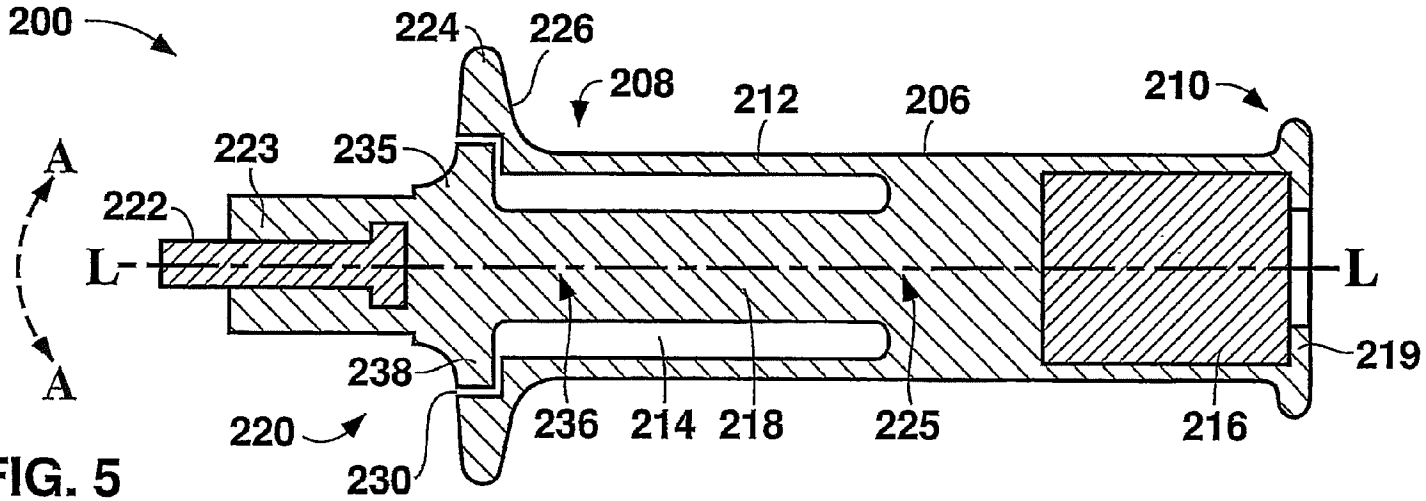
FIG. 5 is a cross-sectional view of the embodiment of FIG. 4, wherein the handle is sectioned through a longitudinal axis of the handle.
Figure 6:
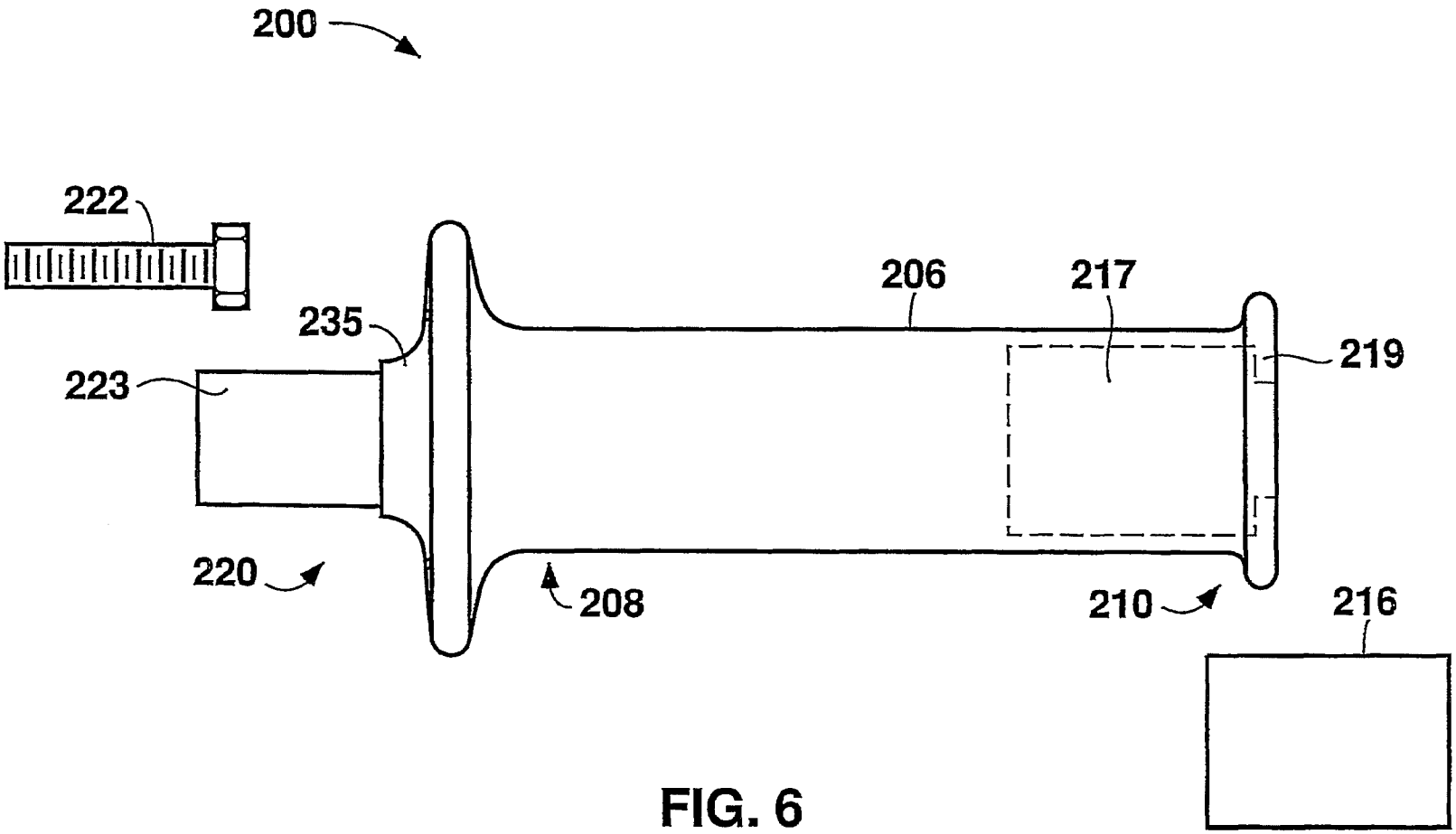
FIG. 6 is an assembly view depicting several component parts of the embodiment of FIG. 4.

FIGS. 4 through 6 schematically illustrate an additional non-limiting embodiment of a vibration dampening handle according to the present disclosure. As in the handle 100 of FIGS. 1 through 3, handle 200 includes a gripping member 206 having a first end 208, an opposed second end 210, and a longitudinal axis L-L that intersects both the first end 208 and the second end 210. A generally cylindrical wall 212 defines an inner bore 214 within the gripping member 206. The inner bore 214 is defined within a portion of the gripping member 206, extends along the longitudinal axis L-L, and opens at the first end 208 of the gripping member 206. A weighted mass 216 is disposed within a cavity 217 in the second end 210 of the gripping member 206 and is retained therein by end wall 219 which, as shown in connection with embodiment 100, can be in the form of a cap that may be secured to the second end 210.

Elastic beam member 218 originates within the inner bore 214 in the vicinity of the second end 210 of the gripping member 206 and extends along the longitudinal axis L-L. A first end 220 of the beam member 218 extends beyond the first end 208 of the gripping member 206. The first end 220 of the beam member 218 includes an end region 235 that may be bonded to (for example, by a friction or some other welding bond) or unitary with reduced diameter region 236 of the beam member 218. The end element 235 of the first end 220 includes a collar portion 223 to which a fastening member 222 is secured. The fastening member 222 is adapted for securing the handle 200 to a powered apparatus. As with handle 100 of FIGS. 1 through 3, elastic beam member 218 is spaced away from and may be deflected laterally (in the directions of curved line A-A) toward wall 212. A resilient material optionally is included in all or a portion of the space between the wall 212 of the gripping member 206 and the beam member 218 to dampen deflection of the beam member 218. The end element 235 of the first end 220 of beam member 218 includes a radially projecting shoulder region 238 disposed within inner bore 214. Sufficient deflection of the beam member 218 causes the shoulder region 238 to contact the inner wall of the bore 214, thereby limiting the degree of such deflection.

As with handle 100, the weight of mass 216, the dimensions (including length and diameter or wall thickness) of the beam member 218, and the materials of construction of the beam member 218 may be selected so that first and second natural frequencies of vibration of the beam member 206 are less than the typical frequency of vibration of the powered apparatus when it is under load and/or is not under load. In this way, handle 200 will dampen vibrations transmitted to the hand of an operator.

The designs of the first end 208 of the gripping member 206 and the first end 220 of the beam member 206 in handle 200 differ from the designs of the corresponding elements in handle 100. First end 220 of gripping member 206 is generally bell-shaped and includes an annular radial projection 224 having a curved surface 226 which blocks an operator's hand from contacting the portion of the powered apparatus to which the handle 200 is connected. In this respect, the projection 224 of handle 200 is similar in function to the projection 124 of handle 100, but the projection 224 also prevents the operator's hand from making contact with the gap 230 between the beam member 218 and the wall 212.

Figure 7:
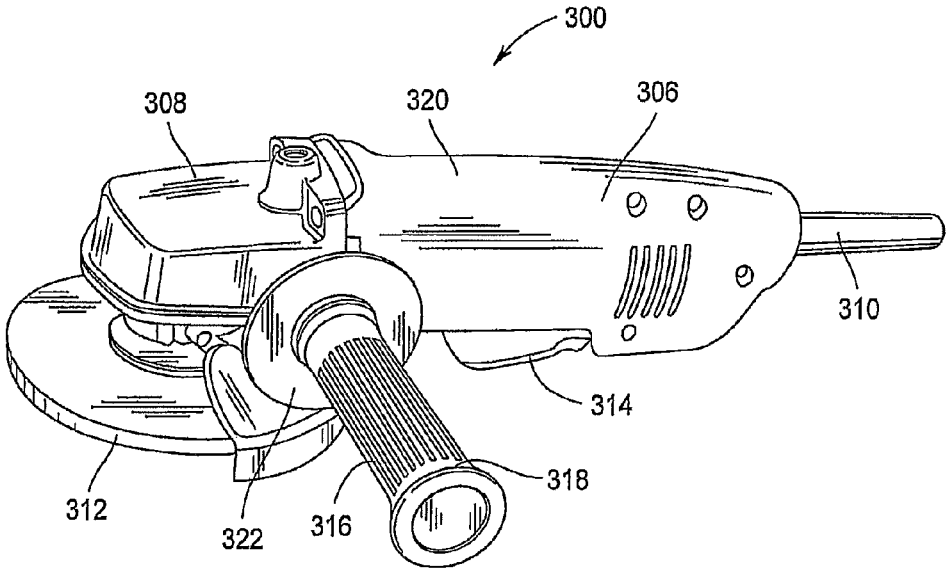
FIG. 7 is a perspective view of a powered small angle grinder including an embodiment of a vibration dampening handle constructed according to the present disclosure.

FIG. 7 depicts one possible powered apparatus with which a handle constructed according to the present disclosure, such as handle 100, handle 200, or any of the embodiments described below, may be used. Powered small angle grinder 300 includes motor housing 306, transmission housing 308, power cord, and abrasive disc 312 that is selectively driven to rotate by engaging trigger 314. A vibration dampening handle 316 constructed according to the present disclosure, including gripping member 318, is connected to transmission housing 308. An operator may grip handle 316 and also grip region 320 of the motor housing 306. Handle 316 may be designed as generally described herein so that the first and second natural frequencies of vibration of the beam member within the handle 316 are lower than a predetermined expected frequency or frequency range of vibration of the transmission housing 308, such as the expected frequency or range of frequencies of vibration of the transmission housing 308 occurring when the disc 310 is driven to rotate and is abrading a workpiece. As an example, a typical range of frequencies of vibration of a small angle grinder of the type illustrated in FIG. 3 under load is 110 to 140 Hz. Thus, first and second natural frequencies of vibration of the beam member of the handle 316 may be sufficiently less than 110 Hz (such as, for example, around 90 Hz) so that the handle 316 will dampen vibrations. As discussed above, in an alternate means to address vibration, the handle 316 may be constructed according to the present disclosure so as to include a beam member have first and second natural frequencies of vibration that are less than an expected frequency or frequency range of vibration of the small angle grinder 300 when the motor of the device is running (i.e., the trigger 314 is engaged), but the abrasive disc 312 is not under load (i.e., the disc is not contacting a workpiece). A typical frequency of vibration of a device as depicted in FIG. 3 under these conditions is about 160 Hz. The vibration dampening capability of handle 316 can improve an operator's control of the grinder 300, and also enhance operator comfort, especially when the grinder 300 is used for extended periods.

Figure 8:
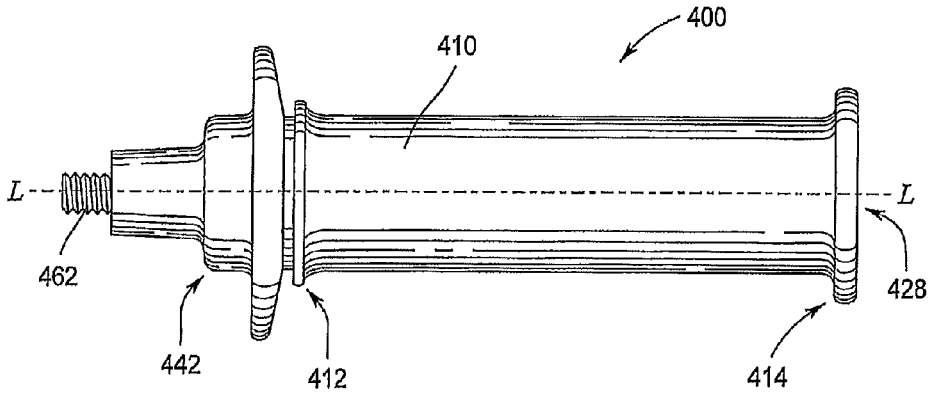
FIG. 8 is a plan view of a third embodiment of a vibration dampening handle constructed according to the present disclosure.
Figure 9:
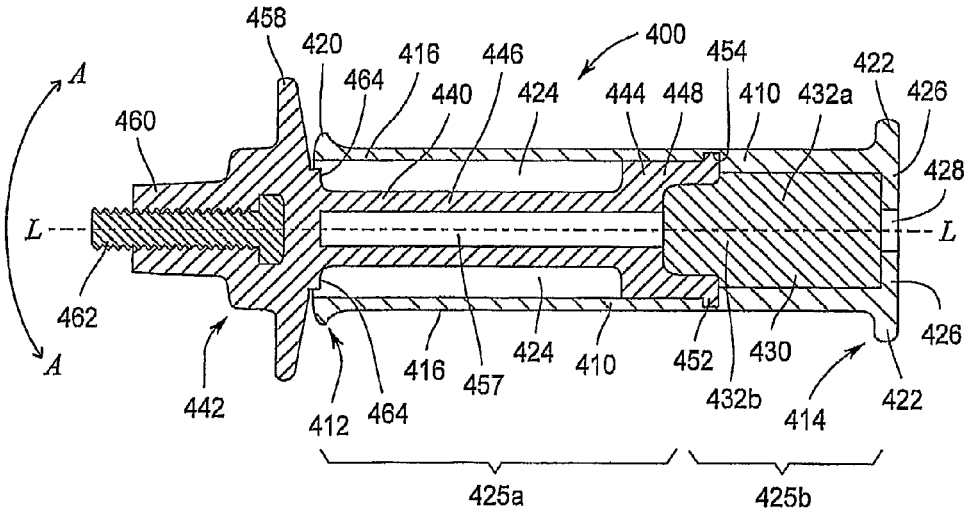
FIG. 9 is a cross-sectional view of the embodiment of FIG. 8, wherein the handle is sectioned through a longitudinal axis of the handle.
Figure 10:
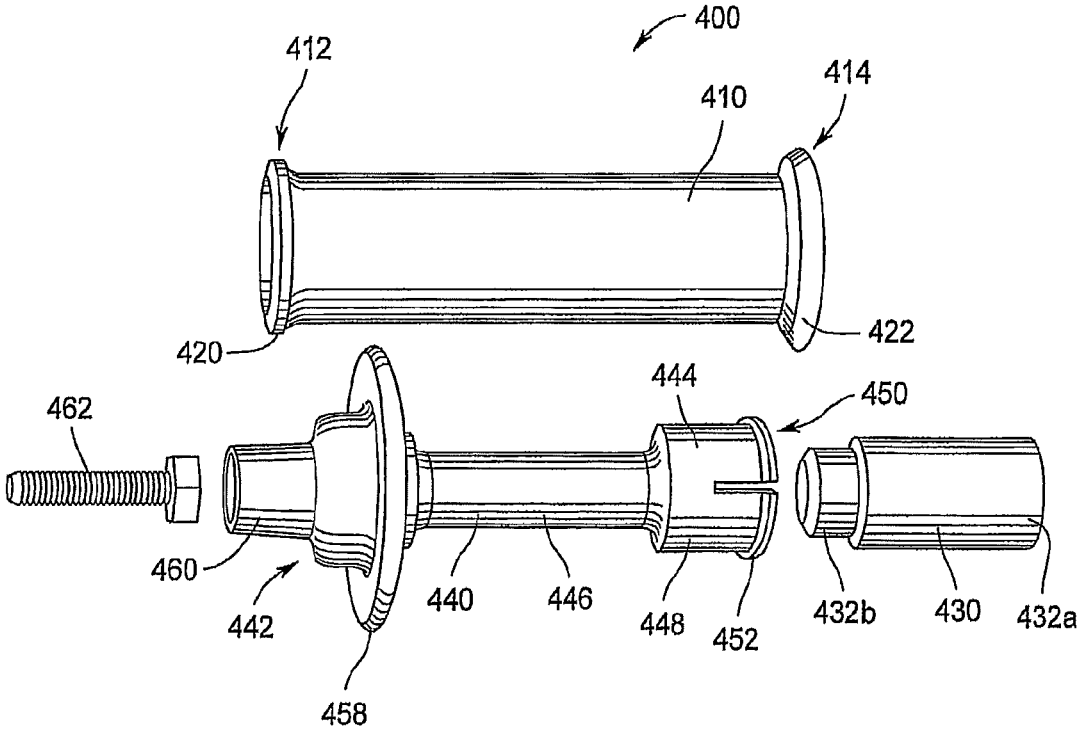
FIG. 10 is an assembly view depicting several component parts of the embodiment of FIG. 8.

FIGS. 8 through 10 illustrate an additional non-limiting embodiment of a vibration dampening handle constructed according to the present disclosure. Referring to FIG. 8, handle 400 is shown. FIG. 9 illustrates handle 400 sectioned through the longitudinal axis L-L of the handle 400. As suggested by FIGS. 8 and 9, longitudinal axis L-L also is an axis of symmetry about which the various exposed features are symmetric, thereby improving the ease of production and assembly. FIG. 10 shows the various parts of the handle 400 prior to assembly.

Handle 400 includes cylindrical gripping member 410 including first end 412, second end 414, and wall 416. The longitudinal axis of symmetry L-L intersects both of the first end second ends 412, 414. The first end 412 and the second end 414, respectively, include annular radial projections 420, 422, which inhibit an operator's hand from slipping off of the gripping member 410 during use of the powered apparatus. As shown in FIG. 9, wall 416, which runs the entire length of the gripping member 410, defines an inner bore 424 throughout the length of the gripping member 410. The diameter of the inner bore 424 is greater in region 425*a*, in the vicinity of the first end, and then steps down to region 425*b* having a smaller diameter in the vicinity of the second end 414. Each region 425*a* and 425*b* shares longitudinal axis L-L as an axis of symmetry. The inner bore 424 opens on the first end 414 with a diameter that is essentially equal to the widest inner diameter of the inner bore 424. In contrast, end wall 426 restricts the opening of the inner bore 424 on the second end 414 to a relatively small centrally disposed circular opening 428. In one embodiment, the gripping member 410 is constructed of a suitable plastic using conventional injection molding techniques, although any suitable combination of materials and manufacturing techniques may be used. During assembly of handle 400, cylindrically shaped mass 430 is inserted in the inner bore 424 through the first end 414 and is slid down to be positioned at the second end 414. The outer diameter of region 432*a* of mass 430 closely approximates the diameter of region 425*b* and closely seats within region 425*b*, where it is prevented from exiting second end 414 by end wall 426. Mass 430 also includes a projecting region 432*b* of smaller diameter than region 432*a*. Mass 430 may be composed of any material of suitable density such as, for example, a metallic material, a ceramic, or a dense plastic.

Beam member 440 of handle 400 includes first end 442, second end 444, and reduced-diameter region 446, and is symmetric about longitudinal axis L-L in assembled handle 400. As shown in FIGS. 9 and 10, second end 444 has an outer diameter closely approximating the inner diameter of region 425*a*. Second end 444 is generally bell-shaped and includes a cylindrical wall 448 defining a cavity 450 shaped so as to substantially match the outer contour of region 432*b* of mass 430. Cylindrical wall 448 includes an annular projecting lip 452 that is received in an annular channel 454 formed on the inner surface of wall 416 of the gripping member 410 at the end of region 425*a*. To retain mass 430 and second end 444 of the beam member 440 within the inner bore 424, mass 430 is first disposed within region 425*b* of the gripping member 410 and then second end 444 is slid into the inner bore 424 until lip 452 is snap fit into annular channel 454. Mass 430 is thereby secured in region 425*b*, and region 432*b* is securely retained in cavity 450. It will be understood that given the need to allow for slight elastic compression of wall 448 to accomplish the snap fit mating into channel 454, it may be necessary to provide one or more gaps or notched regions in cylindrical wall 448.

Again referring to FIGS. 9 and 10, an inner cylindrical cavity 457 is provided in beam member 440 in order, for example, to reduce weight and materials costs associated with the handle 400, and to improve the ability to manufacture the handle 400. First end 442 of beam member 440 includes annular radial projection 458 and cylindrical collar 460. Referring to FIG. 10, fastening member 462 is retained in a bore in the first end 442 and extends from collar 460. The collar 460 and the fastening member 462, which may be, for example, the threaded member shown in FIGS. 8 through 10, are secured within a bore in a housing of the powered apparatus to connect the handle 400 to the apparatus. Projection 458, which is adjacent the first end 412 of the gripping member 410 when the parts are assembled, acts to block an operator's hand from contacting the apparatus housing to which the handle 400 is connected during operation of the apparatus. Region 446 of beam member 440 is of reduced diameter relative to second end 444 and is spaced apart along its entire length from wall 416. As shown in FIG. 9, annular shoulder 464 of first end 442 opposes and is spaced apart from wall 416, and the remainder of first end 442 extends beyond the gripping member 410 when beam member 440 is secured within the inner bore 424 of the gripping member 410. Beam member is constructed of a material having elastic properties allowing it to be elastically deflected relative to the gripping member 410. As will be understood from FIG. 9, the range of deflection of the beam member 440 relative to the gripping member 410, indicated by the curved arrow A-A, is limited by the width of the gap provided between shoulder 464 and the wall 416.

Beam member 440 is constructed of a suitable elastic material such as, for example, a plastic having desirable stiffness properties, and is manufactured using conventional techniques such as, for example, blow or injection molding. As discussed above in connection with the embodiments of the handles illustrated in FIG. 1 through 6, the weight of mass 430 and the dimensions and material of construction of the beam member 440 may be selected so that the first and second natural frequencies of vibration of the beam member are less than a frequency of vibration of the powered apparatus commonly occurring when the powered apparatus is under load. In this way, the degree of vibration to which the hand of an operator gripping the handle 400 is subjected is reduced, improving operator control and comfort. In certain embodiments of handle 400, the parts may be designed so that the first and second natural frequencies of vibration of the beam member 440 are less than a frequency of vibration of the powered apparatus commonly occurring when the powered apparatus is not under load, which dampens vibration of the handle when the powered apparatus is in an idling state. The limited number of parts included in handle 400, and the simple "slide and snap" method of assembling the parts, provide for ease of manufacture.

Figure 11:
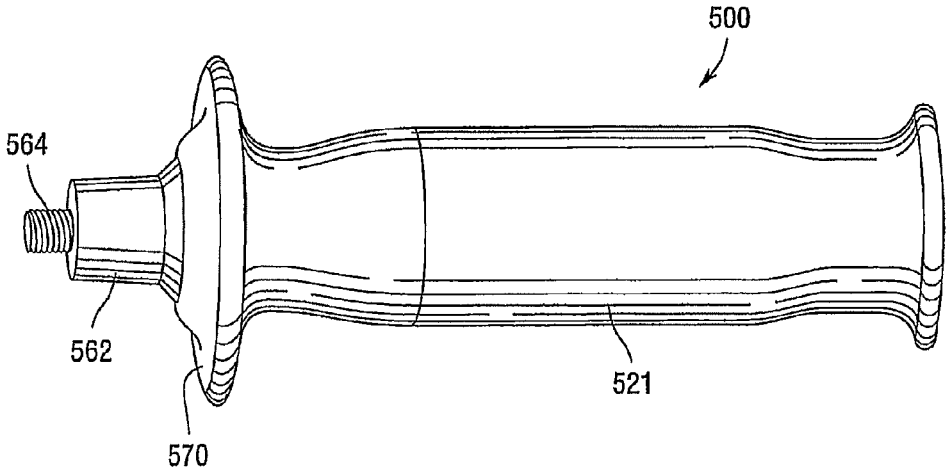
FIG. 11 is a plan view of a fourth embodiment of a vibration dampening handle constructed according to the present disclosure.
Figure 12:
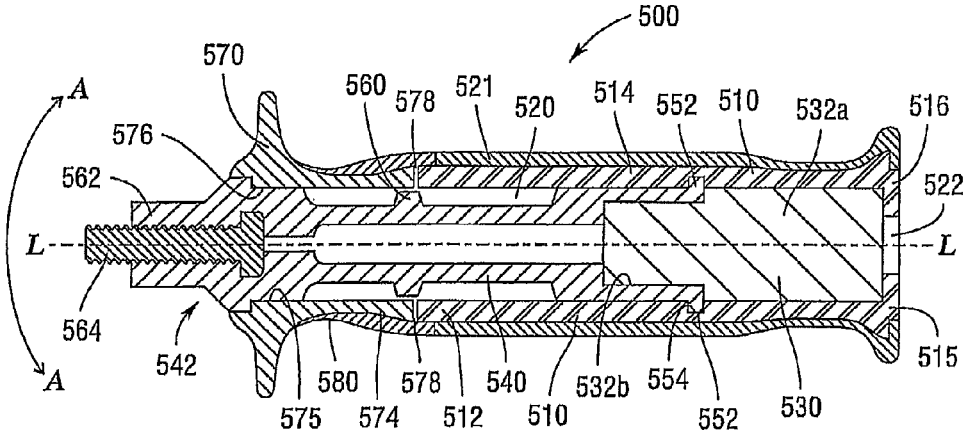
FIG. 12 is a cross-sectional view of the embodiment of FIG. 11, wherein the handle is sectioned through a longitudinal axis of the handle.
Figure 13:
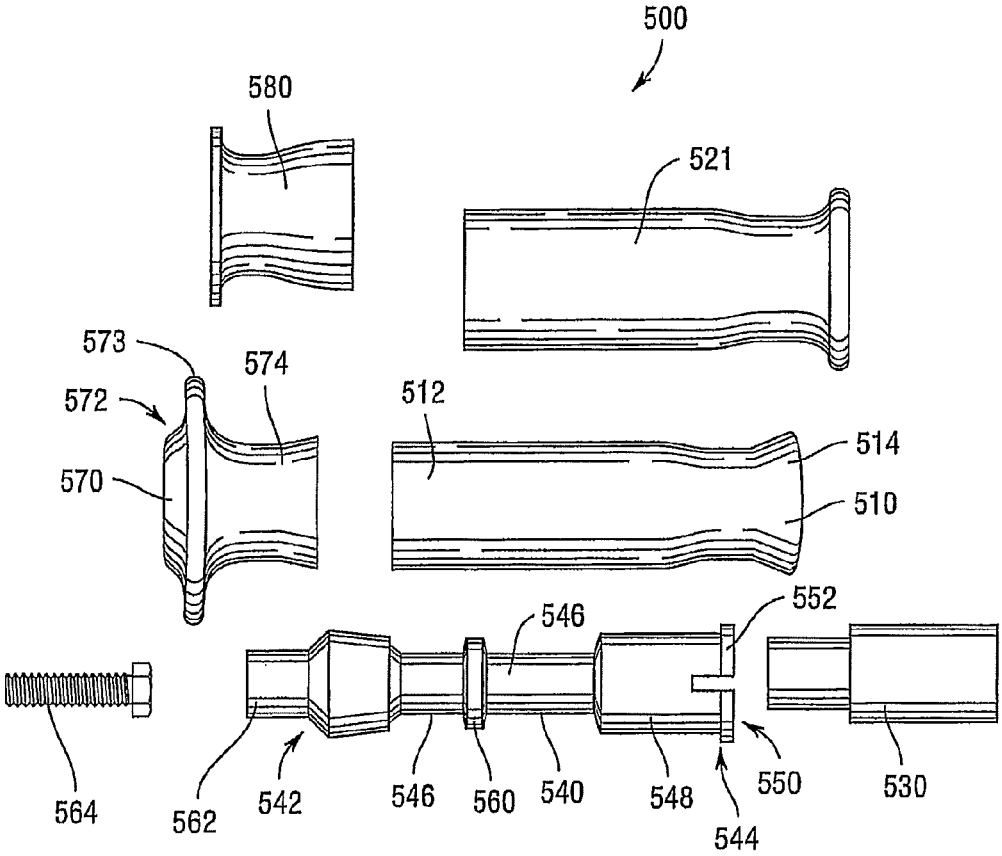
FIG. 13 is an assembly view depicting several component parts of the embodiment of FIG. 11.

Yet an additional non-limiting embodiment of a vibration dampening handle according to the present disclosure is shown in FIGS. 11 through 13. Handle 500 includes gripping member 510 having a first end 512, a cylindrical side wall 514, an end wall 516, and a longitudinal axis L-L about which the gripping member 510 is symmetric. Wall 514 defines an inner bore 520 running the length of the gripping member 510. Inner bore 520 opens onto first end 512 and also opens onto second end 515 through circular opening 522, which is bounded by end wall 516. Plastic or rubber coating member 521 is provided about the outer surface of the gripping member 510 to reduce slipping and improve comfort for an operator's hand gripping the handle 500. The coating extends to the terminus of second end 515 of the gripping member 510, but is spaced a distance away from the terminus of first end 512, leaving an end region of the exterior of wall 516 uncovered by coating member 521. Coating member 521 may be applied using traditional manufacturing techniques. For example, as suggested by the assembly view of FIG. 13, coating member 521 may be in the form of an elastic sleeve that is slipped onto and retained by its shape and elastic properties about the gripping member 510.

Similar to handle 400, handle 500 further includes mass 530 including a first region 532*a* and a smaller diameter second region 532*b*. Mass 530 is retained within second end 515 of the gripping member 510 in a manner substantially the same as with handle 500. More specifically, handle 500 also includes beam member 540 having a first end 542, an opposed second end 544 and a reduced diameter region 546 intermediate the first and second regions 542, 544. As suggested in FIG. 12, beam member 540 is hollow through its length and is generally symmetric about longitudinal L-L when assembled into handle 500. Second end 544 is generally bell-shaped and includes a cylindrical wall 548 defining a cylindrical cavity 550 having dimensions that will accept the second region 532*b* of the mass 530. The terminus of cylindrical wall 548 includes a radially projecting lip 552 that securely snap-fits into an annular groove 554 formed on the inner surface of wall 514 of the gripping member 510. Similar to handle 400, wall 548 of the second end 544 may be notched or otherwise modified in form to allow suitable elastic compression of the second end 544 when snap fitting flange 552 into groove 554. As shown in FIG. 12, when assembled with flange 552 seated in groove 554, the beam member 540 is securely retained within the inner bore 520 of the gripping member 510, and also securely retains the mass 530 within the second end 515 of the gripping member.

The portion of the reduced diameter region 546 disposed with the inner bore 520 is spaced away from the wall 516. Given that the beam member 540 is securely attached to the gripping member 510 as just described, and further given that the beam member 540 is constructed from a suitably elastic material such as, for example, a plastic having suitable stiffness properties, it will be understood that beam member 540 may be laterally deflected over a range of motion in all radial directions relative to the gripping member 510. This is suggested in FIG. 12 by line A-A. Annular shoulder 560 projects from region 546 and opposes, but is spaced apart from, the terminus of wall 514 at the first end 512 of the gripping member 510. The gap between wall 514 and shoulder 560 defines a limit of possible lateral deflection of the beam member 540 and prevents over-deflection of the beam member 540. Resilient material such as, for example, plastic or rubber, may be disposed in all or a region of the space between the inner surface of wall 516 and the outer surface of the region 546 of the beam member 540 to dampen deflection of the beam member 540 relative to the gripping member 510. The reduced diameter region 546 of the beam member 540 continues beyond the first end 512 of the gripping member and flares out to form first end 542. First end 542 includes collar 562 defining a bore into which fastener 564 is secured. The collar 562 and the fastener 564 may be secured in a bore in a housing or other element of the powered apparatus to secure the handle 500 to the powered apparatus.

Hollow flange member 570 includes first end 572 including annular radial projection 573, and second end 574. The inner diameter 575 of the flange member 570 is secured about the outer diameter 576 of the first end 542 of the beam member 540 so that the terminus of the second end 574 opposed but is slightly spaced apart from the terminus of side wall 514 of the gripping member 510. It will be understood and is shown in FIG. 12 that a slight gap 578 exists between the flange member 570 and the gripping member 510. To prevent an operator's hand from contacting the gap 578, a sleeve member 580 having an inner shape conforming to a region of the outer surface of the flange member 570 overlays the gap 578 and extends to cover a margin of the outer surface of the wall 514 that is not covered by coating member 521. The flange member 570 and the sleeve member 580 may be constructed of any suitable materials, using any suitable conventional manufacturing techniques. For example, the members may be manufactured of a suitable resilient plastic using injection molding or blow molding techniques.

According to an aspect of the present disclosure, the weight of mass 530 and the dimensions and material of construction of the beam member 540 may be selected so that the first and second natural frequencies of vibration of the beam member 540 are less than a frequency or range of frequencies of vibration of the powered apparatus commonly occurring when the powered apparatus is or is not under load. In this way, the degree of vibration to which the hand of an operator gripping the handle 500 is subjected is reduced, improving operator control and comfort.

Additional possible embodiments of a vibration dampening handle for a powered apparatus are illustrated in the FIGS. 14 through 25, as follows. In each of these embodiments, to dampen vibrations, the weight of the mass and the dimensions and materials of the beam member of the handle may be pre-selected so that at least the first and second standing frequencies of vibration of the beam member are less than a predetermined typical expected frequency or range of frequencies of vibration of the particular powered apparatus to which the handle would be connected.

Figure 14:
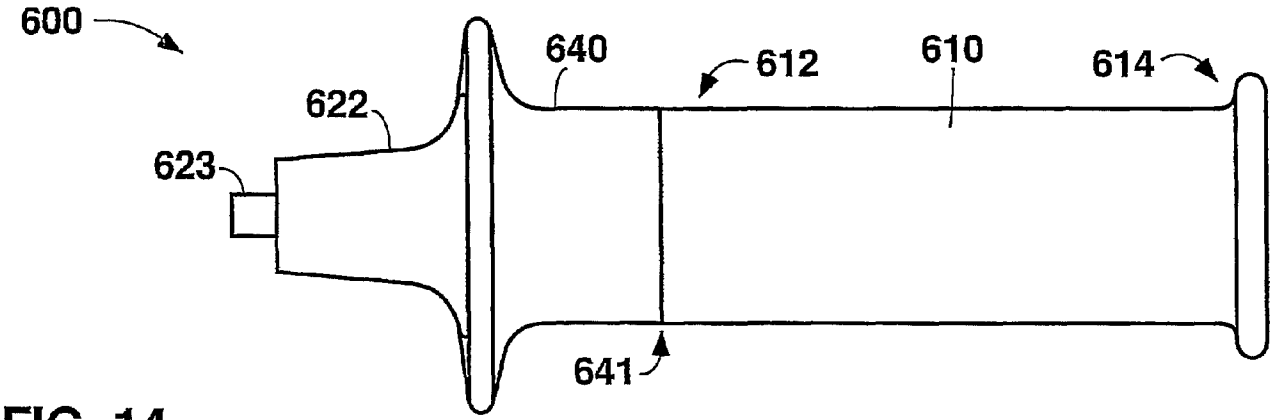
FIG. 14 is a plan view of a fifth embodiment of a vibration dampening handle constructed according to the present disclosure.
Figure 15:
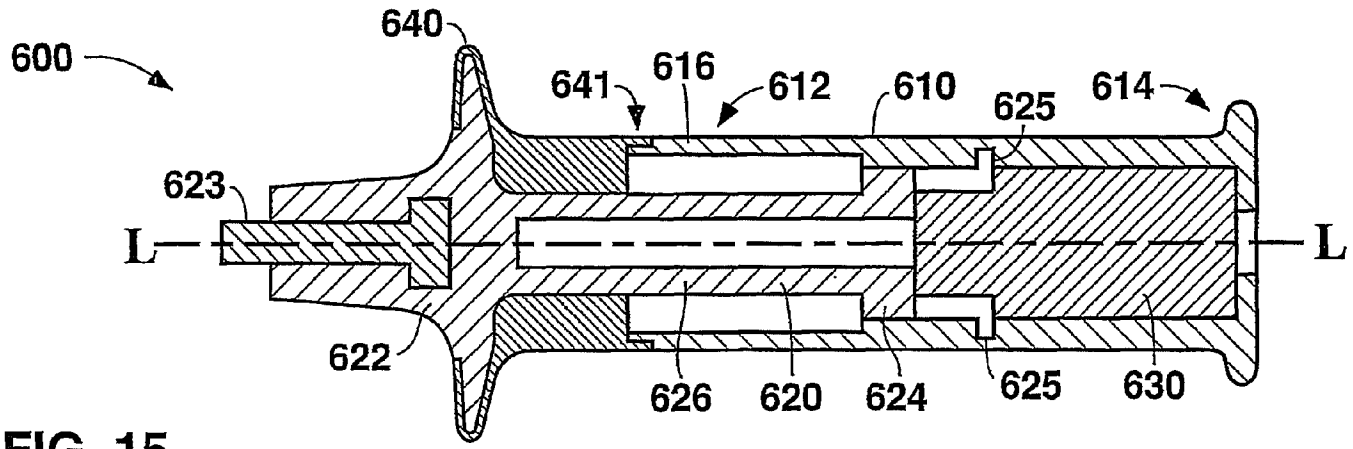
FIG. 15 is a cross-sectional view of the embodiment of FIG. 14, wherein the handle is sectioned through a longitudinal axis of the handle.
Figure 16:
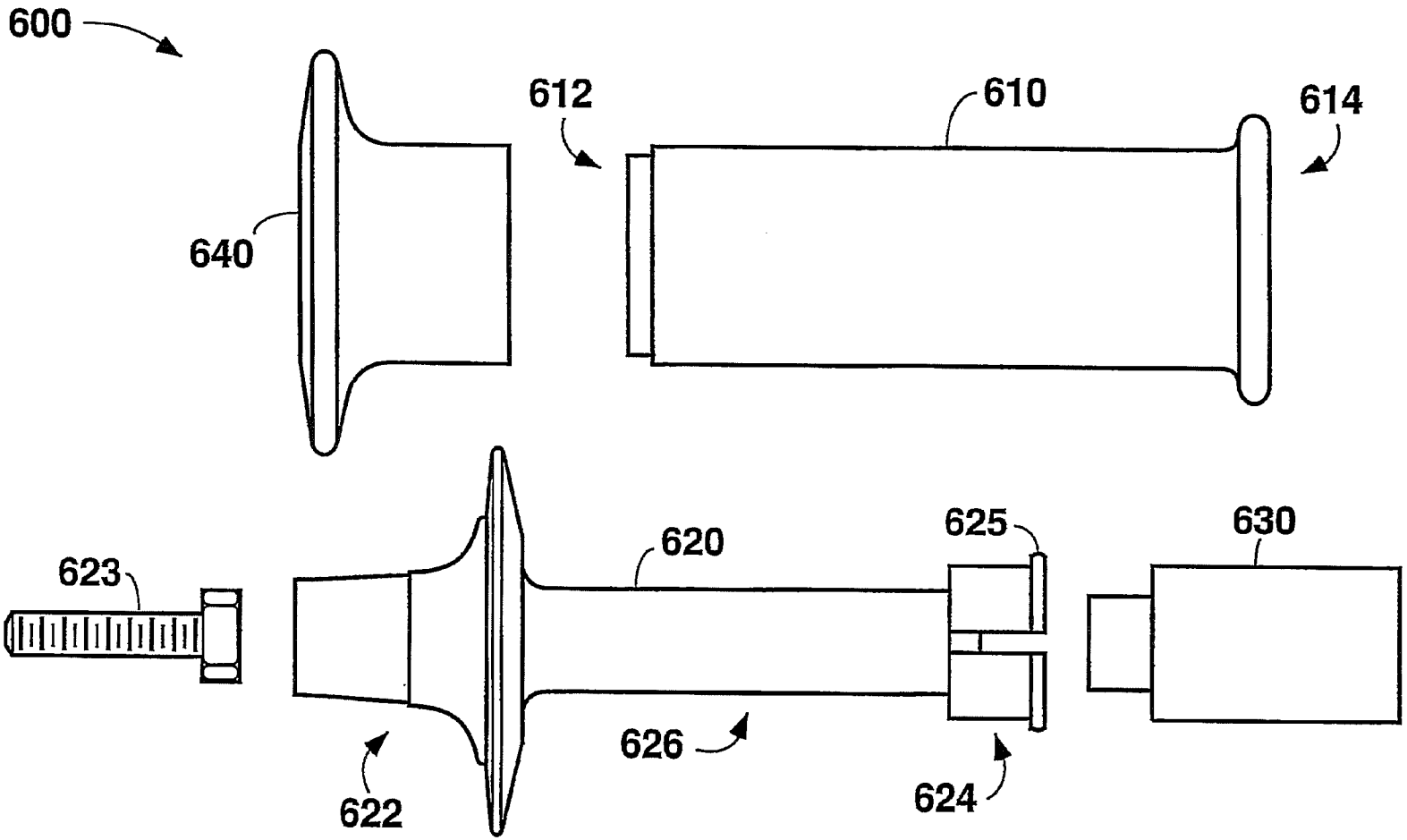
FIG. 16 is an assembly view depicting several component parts of the embodiment of FIG. 14.

FIGS. 14 through 16 are different views depicting one possible embodiment of a vibration dampening handle 600 according to the present disclosure. With reference to FIGS. 14 through 16, handle 600 includes generally cylindrical gripping member 610 having first end 612, second end 614, and longitudinal axis L-L, about which the gripping member 610 is symmetric. Beam member 620 includes first end 622 (to which is attached a fastening member 623), second end 624, and reduced diameter region 626 intermediate the first end 622 and the second end 624. Mass 630 is retained at the second end 614 of the gripping member 610 by a snap fit arrangement connecting the beam member 620 to the gripping member 610 by snap hooks 625 on second end 624. This snap fit arrangement is similar to the embodiments of FIGS. 8 through 13. As best shown in FIGS. 14 and 15, funnel-shaped shoulder member 640, composed, for example, of a resilient plastic or rubber material, is secured to a surface of the beam member 620. As shown in FIG. 15, shoulder member 640 overlaps the terminus of the wall 616 of the gripping member 610 in a region 641, thereby avoiding a gap between the shoulder member 640 and the gripping member 610. As shown by comparing the handle 500 of FIGS. 11 through 13 to handle 600 of FIGS. 14 through 16, the design of the first end 622 of the beam member 620 of handle 600 that results from securing the shoulder member 640 to the first end 622 is similar to the design of the first end 542 of the beam member 540 of handle 500 that results from attaching the flange member 570 and the coating member 580 to the first end 542.

Advantages of the design of handle 600 of FIGS. 14 through 16 relative to the design of handle 500 of FIGS. 11 through 13 include the use of three basic parts (elements 620, 623, and 640) in handle 600, versus the use of four basic parts (elements 540, 564, 570, and 580) in handle 500 to provide the assemblage of elements that may be deflected relative to the gripping member. The shoulder member 640 of handle 600, however, must be, for example, adhesively secured or molded into the first end 622 of the beam member 620. This contrasts with the assembly of flange member 570 and coating member 580 of handle 500, which may be designed to snap or press fit about the surface of the elements they overlie.

Thus, handle 500 may provide an advantage in terms of ease of manufacture relative to handle 600. Also, beam member 620 of handle 600 lacks any distinct structure limiting the degree of lateral deflection of the beam member 620 relative to the gripping member 610. Instead, in theory the beam member 620 may be laterally deflected until the periphery of the region 626 of the beam member 620 contacts the first end 614 of the gripping member 610. In contrast, annular shoulder 560 of the beam member 540 of handle 500 may be designed to limit lateral deflection of the beam member 540 to a degree that can be safely tolerated by the mechanical characteristics of the beam member 540.

Figure 17:
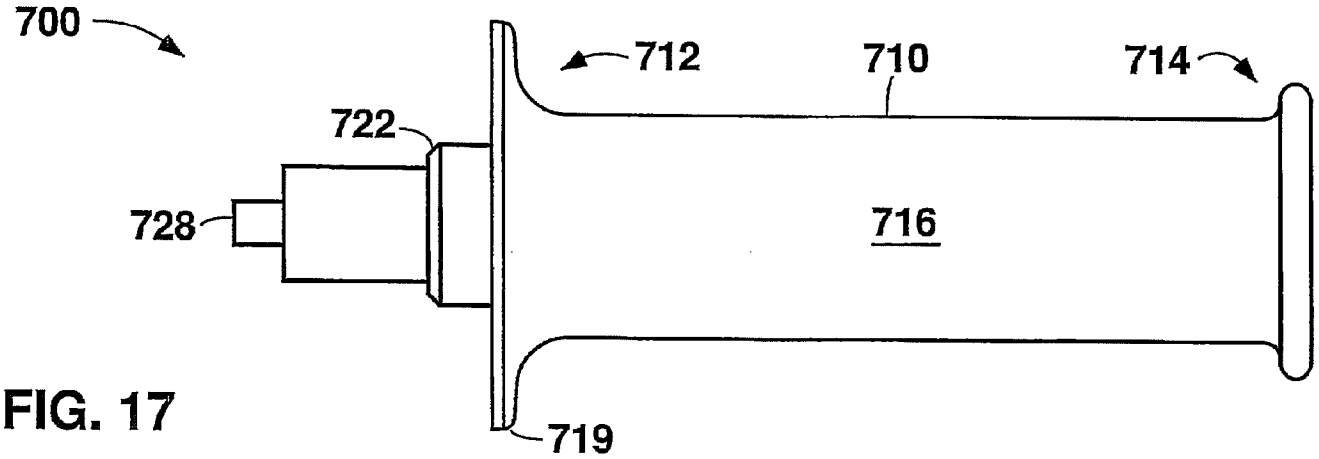
FIG. 17 is a plan view of a sixth embodiment of a vibration dampening handle constructed according to the present disclosure.
Figure 18:
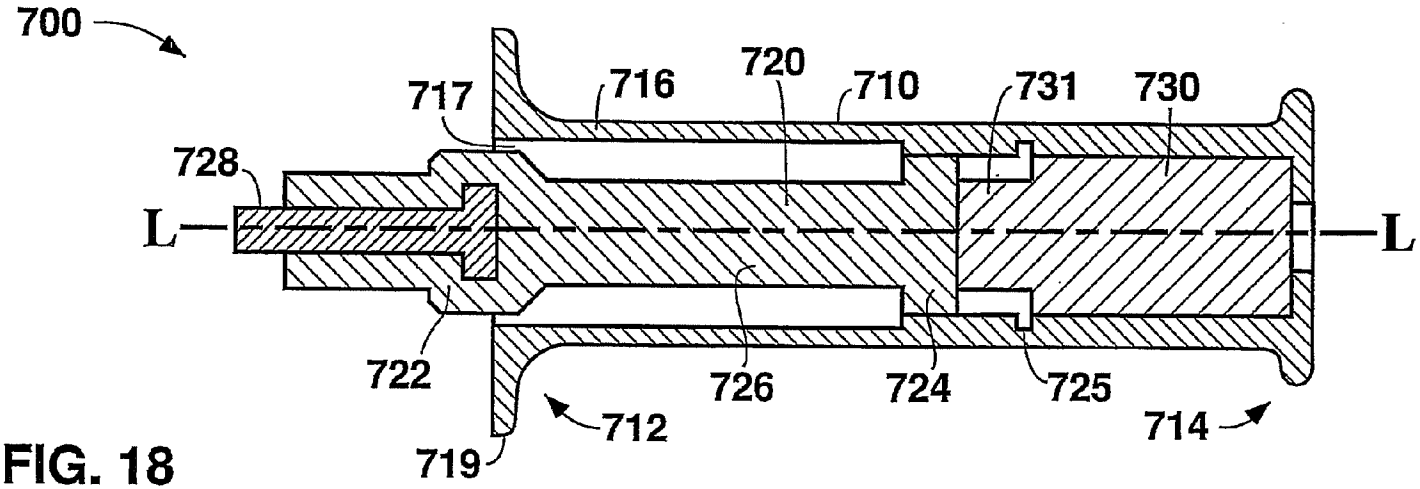
FIG. 18 is a cross-sectional view of the embodiment of FIG. 17, wherein the handle is sectioned through a longitudinal axis of the handle.
Figure 19:
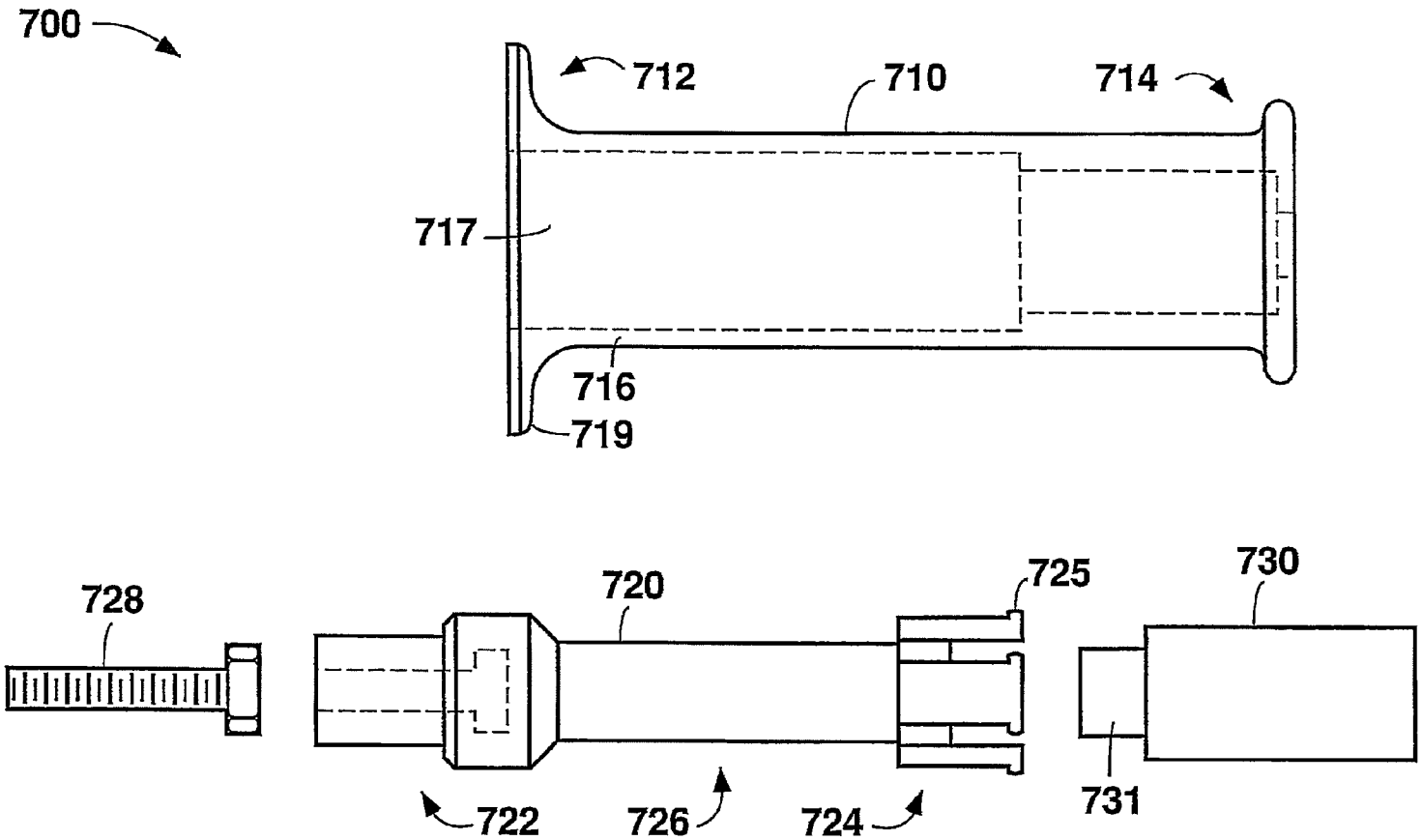
FIG. 19 is an assembly view depicting several component parts of the embodiment of FIG. 17.

Referring to the additional embodiment shown in cross-section in FIGS. 17 through 19, vibration dampening handle 700 includes four parts of relatively simple geometries. As shown in the cross-sectional view of FIG. 18 and the assembly view of FIG. 19, generally cylindrical gripping member 710 includes first end 712, second end 714, wall 716, and longitudinal axis of symmetry L-L. The wall 716 defines a generally cylindrical inner bore 717. First end 712 is flared into radial projection 719, which helps to prevent an operator's hand from slipping off of the gripping member 710. Beam member 720 includes first end 722, opposed second end 724, and reduced diameter section 726 intermediate the first and second ends 722, 724. As indicated in FIG. 18, the second end 724 of beam member 720 includes snap hooks 725 that snap fit into a groove on the inner surface of the gripping member 710, thereby securing the beam member 720 to the gripping member 710 and securely retaining mass 730 within the second end 714 of the gripping member. As best shown in FIG. 18, so at to more securely seat mass 730 within the second end 714 of the gripping member 710, mass 730 includes cylindrical projection 731 that is secured within a similarly shaped cavity within the second end 724 of the beam member 720.

Figure 20:
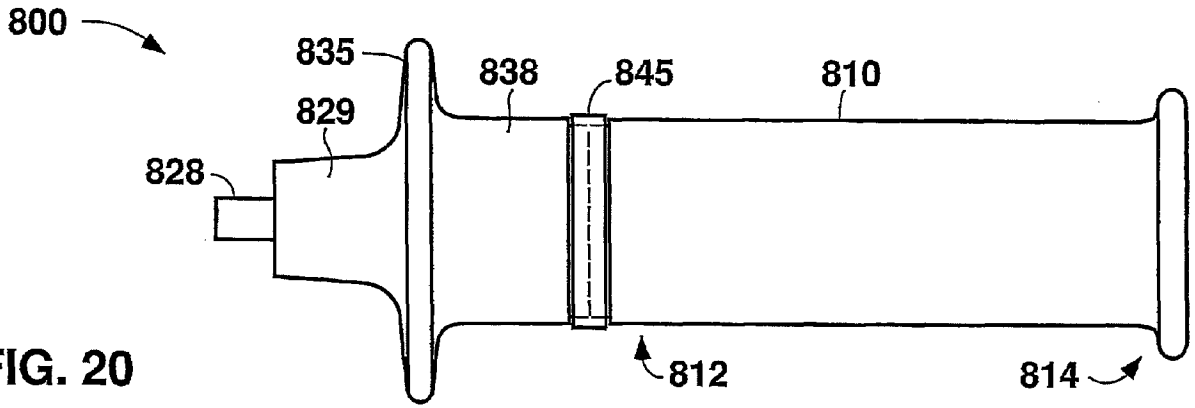
FIG. 20 is a plan view of a seventh embodiment of a vibration dampening handle constructed according to the present disclosure.
Figure 21:
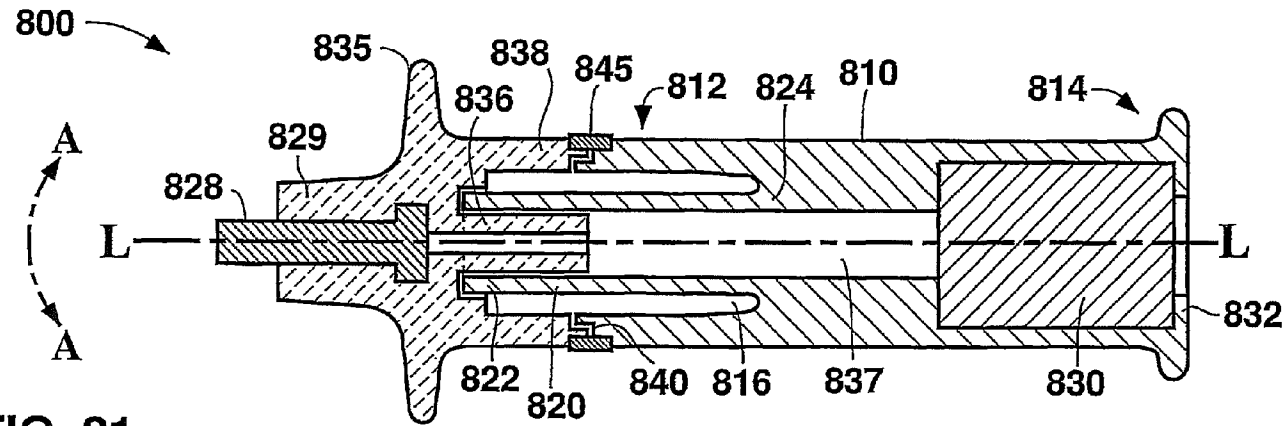
FIG. 21 is a cross-sectional view of the embodiment of FIG. 20, wherein the handle is sectioned through a longitudinal axis of the handle.
Figure 22:
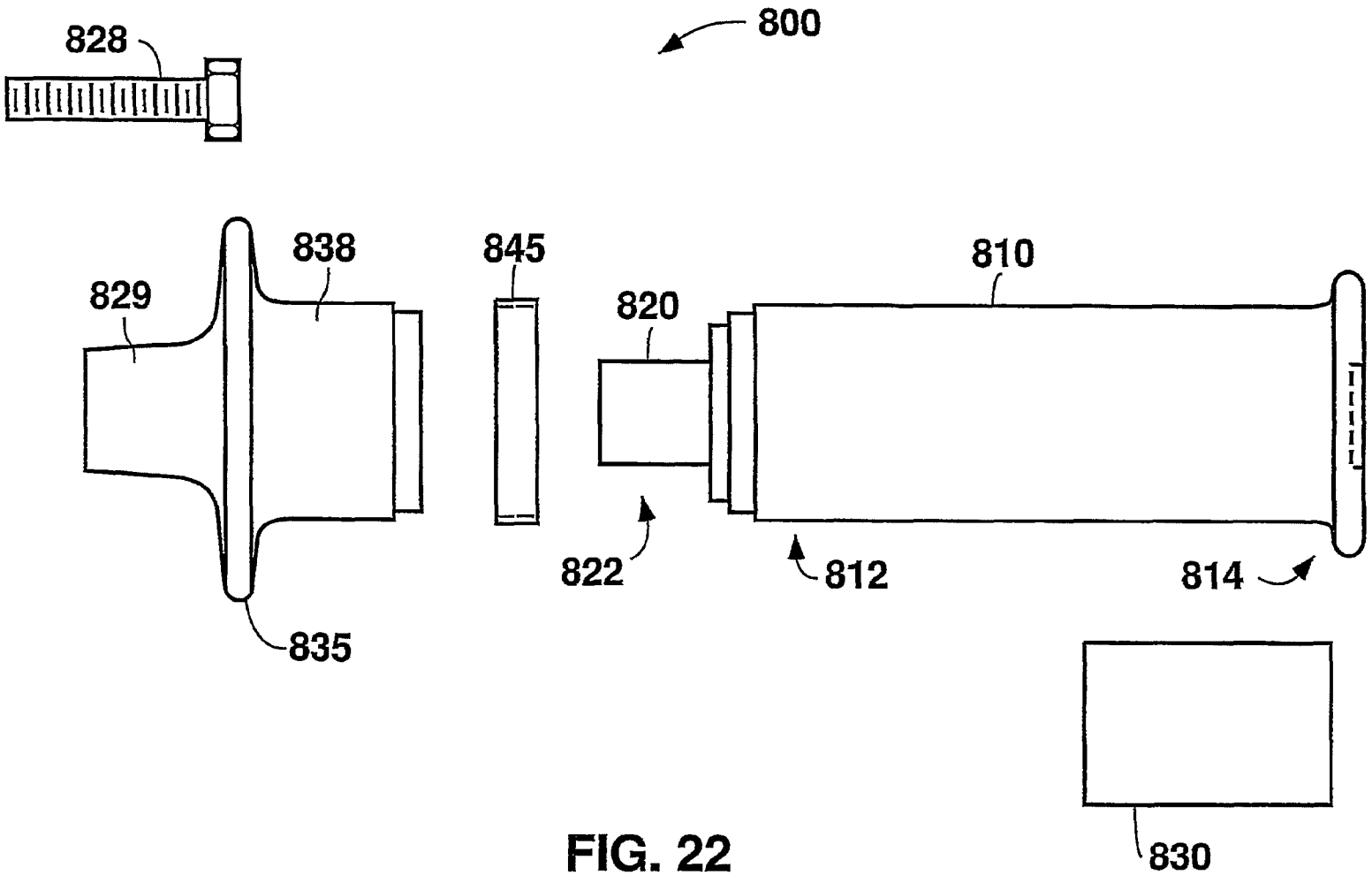
FIG. 22 is an assembly view depicting several component parts of the embodiment of FIG. 20.

FIGS. 20 through 22 illustrate yet another possible non-limiting embodiment according to the present disclosure. FIG. 21 is a schematic cross-sectional view of vibration dampening handle 800 shown in plan view in FIG. 20, taken through longitudinal axis L-L. FIG. 22 is an assembly view showing several component parts of handle 800. As in certain of the embodiments discussed above, handle 800 includes a generally cylindrical gripping member 810 and a beam member 820 that are an integral part. As shown in FIG. 21, the second end 824 of the beam member 820 is integral with the gripping member 810.

As best shown in FIG. 21, the beam member 820 extends along longitudinal axis L-L through the inner bore 816 provided in gripping member 810 and beyond the first end 812 of the gripping member 810. Mass 830 is disposed in a generally cylindrical cavity provided in the second end 814 of the gripping member 810. The mass 830 is retained in the cavity by an end region 832 on second end 814. An end element 835 is secured the first end 822 of the beam member 820 by suitably friction fitting, bonding, or otherwise securing cylindrical stem 836 of the end element 835 within a bore 837 defined by beam member 820. A fastening member 828 is secured to a collar portion 829 of the end element 835.

The first end 812 of the gripping member and the annular skirt region 838 of the end element 835 are configured so that when the end element 835 is secured to the beam member 820, a narrow gap 840 exists between the end element 835 and the first end 812, allowing some deflection of the end element 835 relative to the gripping member 810 in the direction A-A in response to vibration of the apparatus to which handle 800 is connected. To prevent an operator's hand from contacting the gap 840, an annular slot is provided around the perimeter of the handle 800 at the junction of the end element 835 and the gripping member 810. An elastic band 845 is disposed in the slot and is retained therein by the elastic properties of the material from which the band 845 is constructed.

Figure 23:
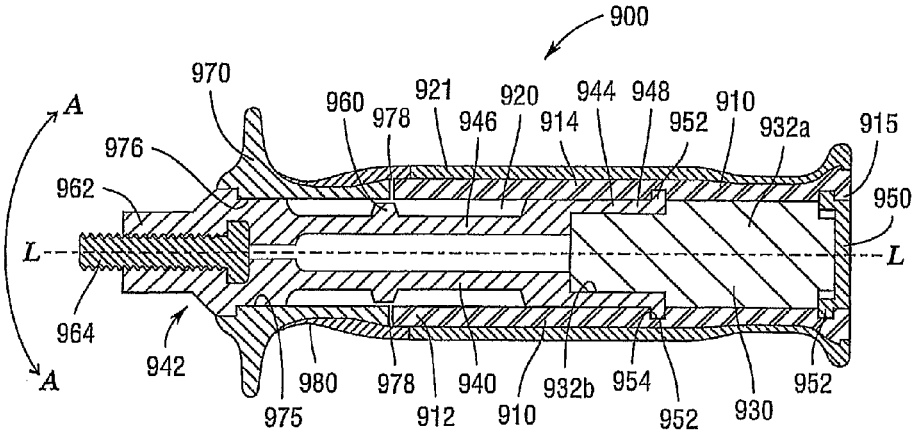
FIG. 23 is a cross-sectional view of an eighth embodiment of a vibration dampening handle constructed according to the present disclosure.

FIG. 23 illustrates a cross section of yet another embodiment of a vibration dampening handle according to the present disclosure. Handle 900 of FIG. 23 is in many respects identical to handle 500 shown in FIGS. 11 through 13. Handle 900 includes gripping member 910 having a first end 912, a peripheral wall 914, and a longitudinal axis L-L. Wall 914 defines an inner bore 920 through the length of the gripping member 910, which opens onto first end 912 and second end 915 of the gripping member 910. Resilient material layer or coating 921 is provided about the outer surface of the gripping member 910 to reduce slipping and improve operator comfort. The coating extends to the terminus of second end 915 of the gripping member 910, but is spaced a distance away from the terminus of first end 912, thereby leaving an end region of the exterior of wall 914 uncovered by coating 921.

Beam member 940 includes a first end 942, an opposed second end 944, and a reduced diameter region 946 intermediate the first and second regions 942, 944. As shown in FIG. 23, beam member 940 of handle 900 is hollow through its length and is generally symmetric about longitudinal axis L-L when assembled into handle 900. Second end 944 is generally bell-shaped and includes a cylindrical wall 948 defining a cylindrical cavity. The terminus of cylindrical wall 948 includes a radially projecting lip 952 that securely snap-fits into an annular groove 954 formed on the inner surface of wall 914 of the gripping member 910. Wall 948 may be constructed so as to allow for suitable elastic compression of the second end 944 when snap fitting lip 952 into groove 954. As suggested in FIG. 23, the snap fit arrangement securely retains beam member 940 within inner bore 920.

Handle 900 includes a mass 930 having a first region 932*a*, a second region 932*b*, and a third region 932*c*. As shown in FIG. 23, mass 930 is disposed within second end 915 of the gripping member 910 so that second region 932*b* of the mass 930 is received within the cavity formed by cylindrical wall 948. A cap member 950 includes flange 952 that is securely received in a snap fit manner within an annular groove formed on the inner periphery of wall 914 near the terminus of the second end 915 of the gripping member 910. The mass 930 is inserted into the gripping member 910 from the second end 915. The cap member 950 secures the mass 930 within the second end 915, between the cap member 950 and the beam member 940. Mass 930 is maintained in the second end 915 with third region 932c flush with the outer end 952 of cap 950 to provide wear resistance.

The portion of reduced diameter region 946 of beam member 940 disposed with the inner bore 920 is spaced away from the wall 914. Given that the beam member 940 is securely attached to the gripping member 910 as described above, and further given that the beam member 940 is constructed from a suitably elastic material, the beam member 940 may be laterally deflected over a range of motion in all radial directions relative to the gripping member 910, as suggested by line A-A. Annular shoulder 960 projects from region 946 and opposes, but is spaced apart from, the terminus of wall 914 at the first end 912 of the gripping member 910. The gap between wall 914 and shoulder 960 defines a limit of possible lateral deflection of the beam member 940 and prevents over-deflection of the beam member 940. Resilient material, such as described above, may be disposed in all or a region of the space between the inner surface of wall 914 and the outer surface of the region 946 of the beam member 940 to dampen deflection of the beam member 940.

Reduced diameter region 946 of the beam member 940 continues beyond the first end 912 of the gripping member forms first end 942. First end 942 includes collar 962 to which fastener 964 is secured. The collar 962 and the fastener 964 may be used to secure the handle 900 to a powered apparatus. Flange member 970 includes an inner diameter 975 that is secured about the outer diameter 976 of the first end 942 of the beam member 940 so that the a terminus of the flange member 970 opposes but is slightly spaced apart from the terminus of side wall 914 of the gripping member 910. A slight gap 978 exists between the flange member 970 and the gripping member 910. To prevent an operator's hand from contacting the gap 978, a sleeve member 980 having an inner shape conforming to a region of the outer surface of the flange member 970 overlays the gap 978 and extends to cover a margin of the outer surface of the wall 914 that is not covered by coating member 921.

Figure 24:
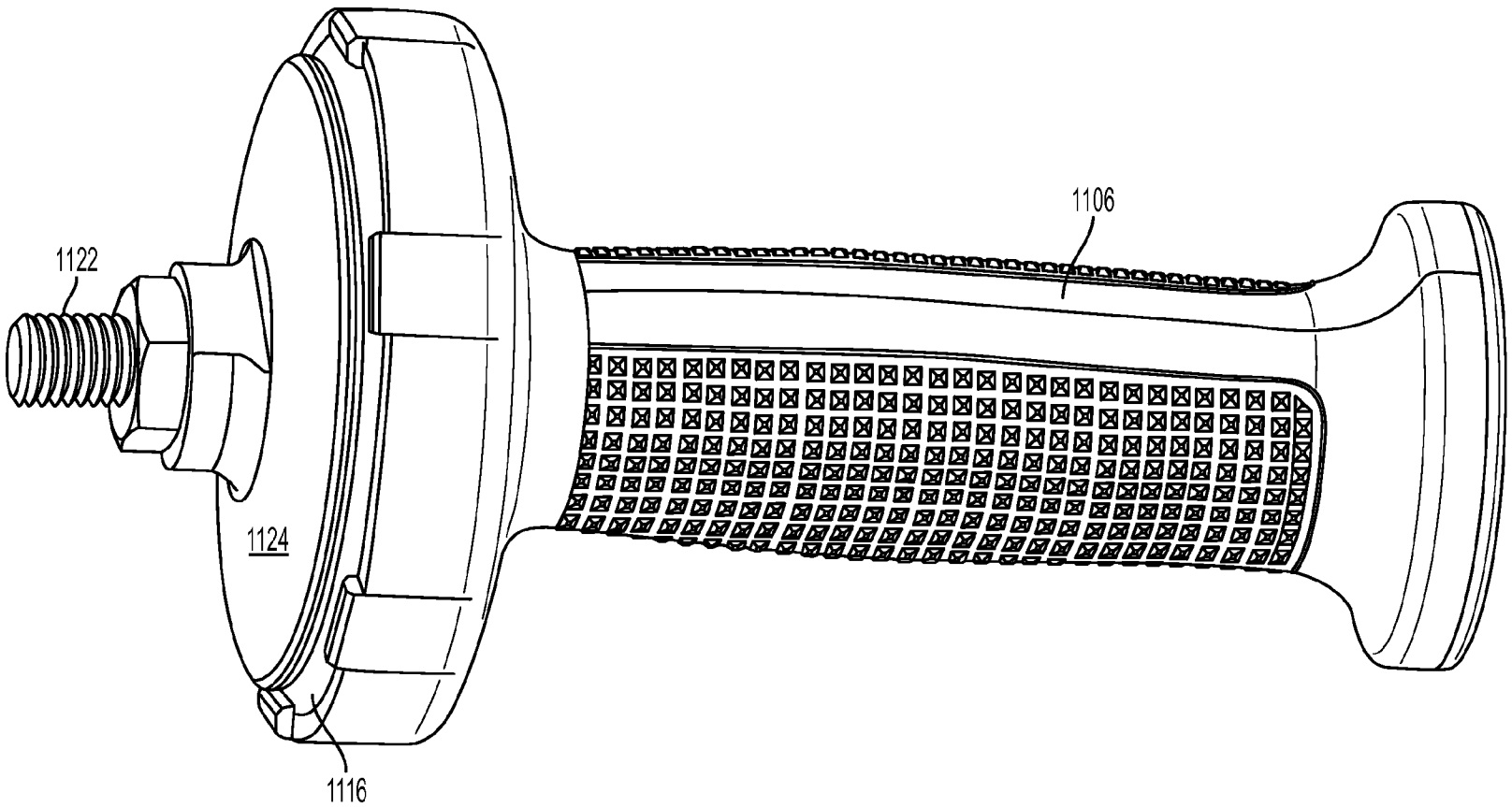
FIG. 24 is a perspective view of an ninth embodiment of the invention.
Figure 25:
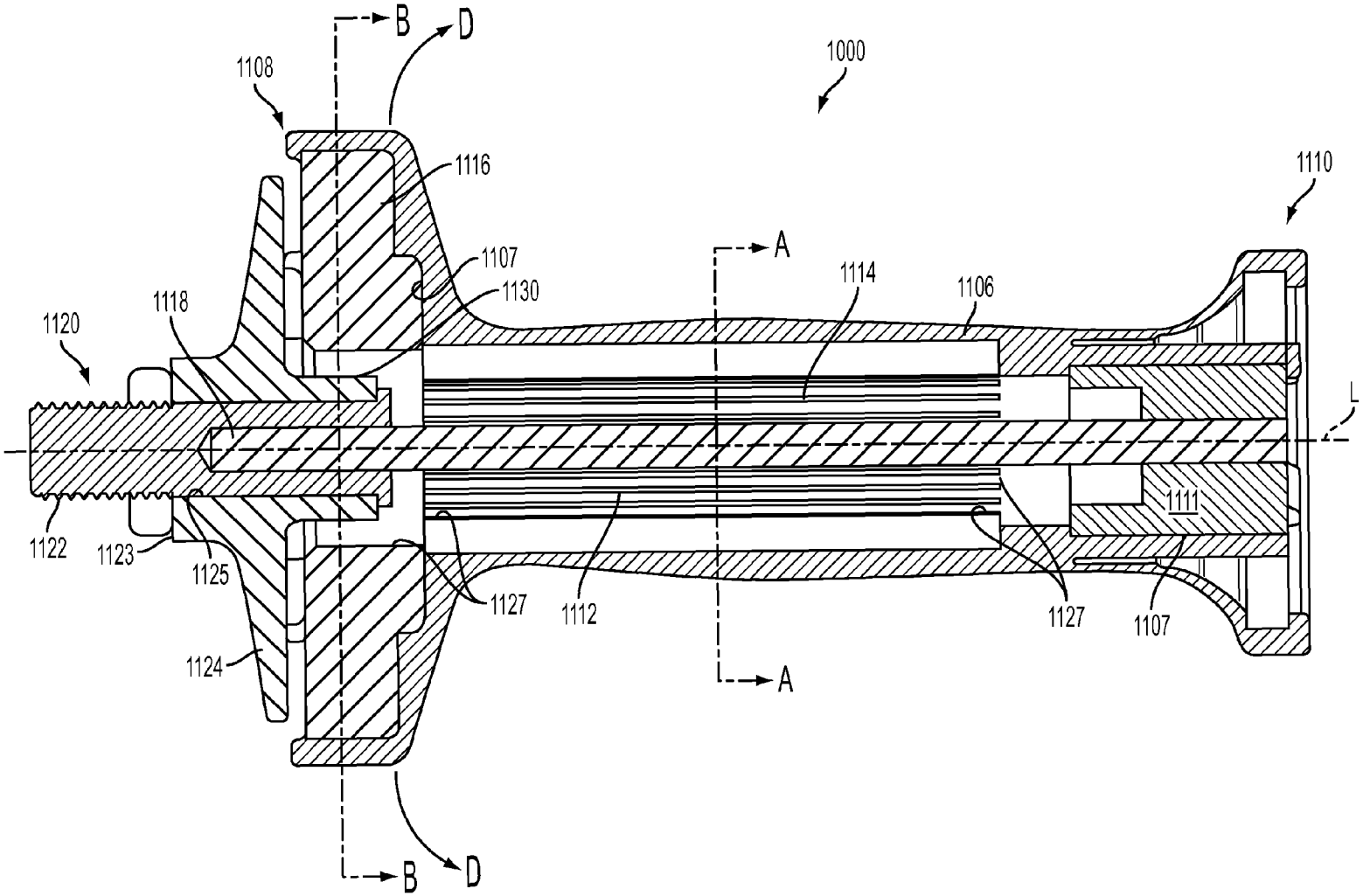
FIG. 25 is a cross sectional view of the embodiment of FIG. 24 in a longitudinal direction.
Figure 26A:
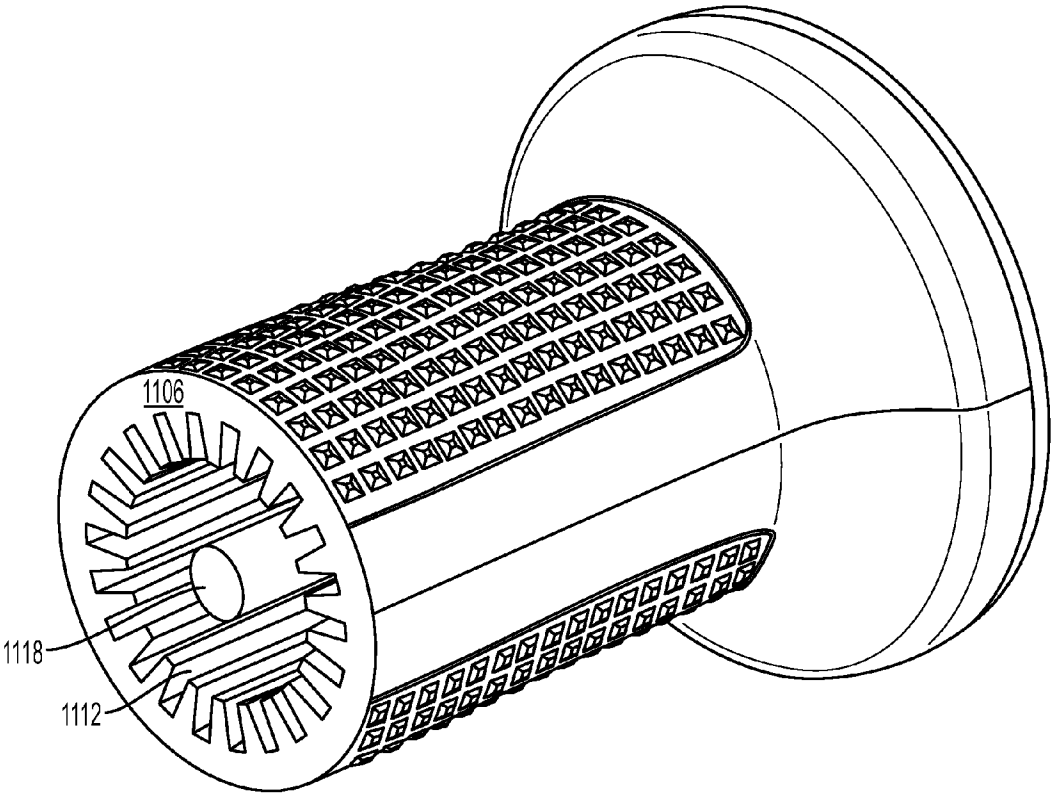
FIG. 26A is a transverse cross section of the embodiment of FIG. 24 through the grip.
Figure 26B:
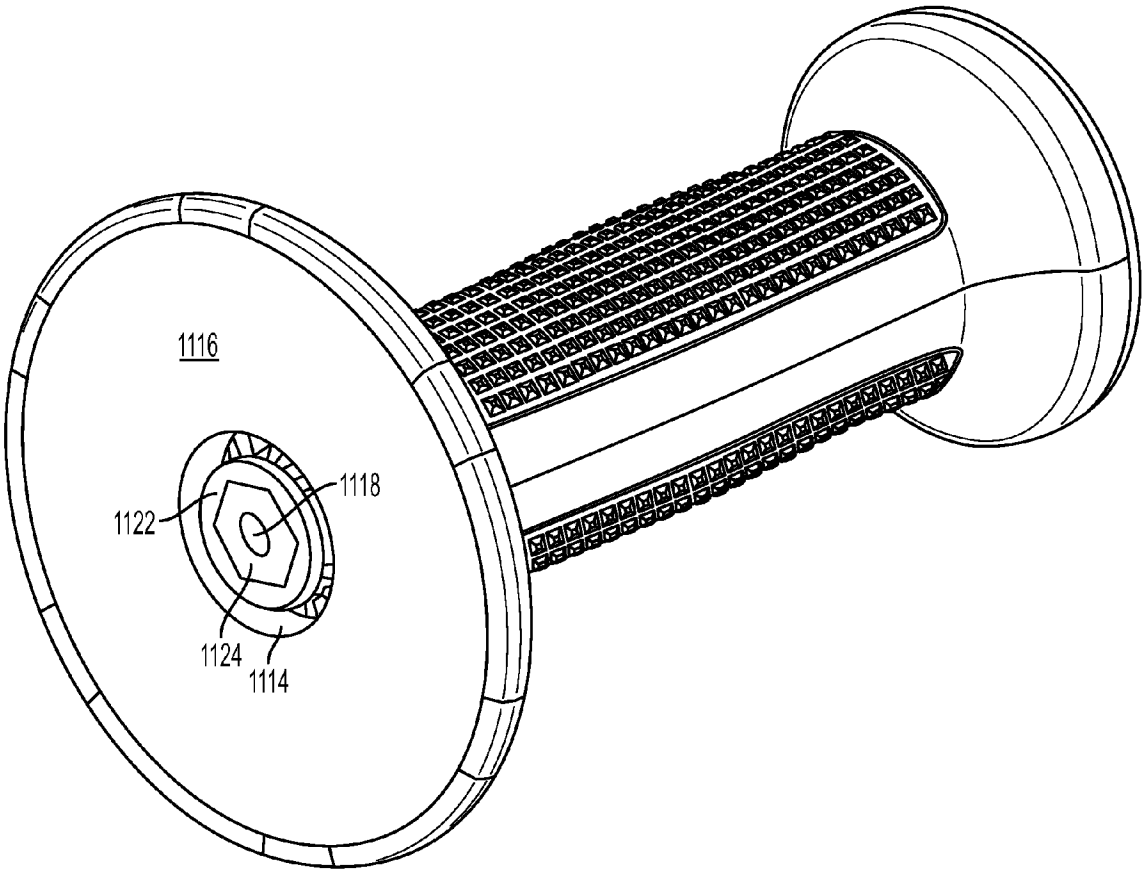
FIG. 26B is a transverse cross section of the embodiment of FIG. 24 through the mass.

FIGS. 24, 25, 26A, and 26B schematically depict another embodiment of a vibration dampening handle according to the present disclosure. FIG. 24 is a front perspective view of the handle. FIG. 25 is a cross section taken through a longitudinal axis of the handle. FIGS. 26A and 26B are cross sections taken transverse to the longitudinal axis of the handle at the locations indicated in FIG. 25.

The gripping member 1106 includes a ribbed wall or peripheral wall 1112 (shown in FIG. 26A) that defines an inner bore 1114 within the gripping member 1106. In certain non-limiting embodiments of handle 1000, and as shown on FIG. 25, inner bore 1114 extends within the gripping member 1106 along at least a region of the longitudinal axis L-L. In certain other embodiments, inner bore 1114 may extend entirely through the gripping member 1106, opening on the first end 1108 of gripping member 1106. In other words, a first end of beam member 1118 is fixed to the tool through fastening member 1122. A second end of beam member 1118 is therefore cantilevered outward from the powered apparatus/tool. A first 1110 end of the gripping member 1106 is connected to a second cantilevered end of beam member 1118 via coupling 1111. Coupling 1111 is secured in the second end of grip member 1106 and coupling 1111 includes an aperture into which a second end of beam member 1118 is secured. A second end 1108 of gripping member 1106 is therefore also cantilevered back toward the tool from the second end 1110 of beam member 1118.

Handle 1000 further includes a mass 1116 (a weight) that is disposed at or near second end 1108 of gripping member 1106. FIGS. 25 and 26B shows the mass as a doughnut-type structure. However, mass 1116 can be fastened to any portion of second end 1108. A purpose of the mass 1116 is to increase the weight of the gripping member 1106 at or near second end 1108 and relative to the first end 1110 of the gripping member 1106. As in the case of the first embodiment, mass 1116 may be, for example, a metallic or ceramic member, or may be composed of a material having a density greater than the material from which the gripping member 1106 is constructed. A homogenous gripping member/mass where the cantilevered end of the gripping member is heavier than the fixed end is contemplated. In fact, any arrangement including equally dense material that concentrates a relatively large mass at the free cantilever end (as compared to the fixed end) of the gripping member is contemplated. The gripping member 1106 is designed so that the mass 1116 may be disposed and securely retained in its position at or near first end 1108 of gripping member 1106. This may be achieved by various means, including providing a cavity 1107 at first end 1108 dimensioned to accept the mass 1116 and retaining the mass 1116 in the cavity using, for example, a cap or clip 1117 secured over the cavity or a fastener or a suitable adhesive that secures the mass 1116 within the cavity 1107. The mass may also snap into or be resiliently received in cavity 1107 which may be constructed of a resilient material.

As in the previous embodiments, the vibration dampening capability of handle 1000 is facilitated by an elastic beam member 1118 that is positioned within the inner bore 1114. The elastic beam member 1118 extends from the vicinity of the second end 1110 of gripping member 1106 and extends generally along the longitudinal axis L-L to the first end 1108 of gripping member 1106. A first end 1120 of the beam member 1118 extends beyond second end 1108 of the gripping member 1106 and includes a fastening member 1122 disposed in a cavity 1125. The fastening member 1122 is for connecting the handle 100 to the powered apparatus. Fastening member 1122 is secured to collar 1123 and may have any suitable form. For example, fastening member 1122 may be a threaded member. To secure the handle 1000 to the powered apparatus, the collar 1123 and fastening member 1122, for example, may be secured within a threaded female bore in a housing of the powered apparatus. First end 1120 of beam member 1118 may have any suitable shape.

As shown in FIG. 25, the second end of beam member 1118 is configured to mate with a coupling 1111 of the gripping member 1106 and thereby securely connects the members together. Although the term "member" is used in the present description in connection with the gripping member, the beam member, and the fastening member, such use does not preclude the possibility that two or more of the gripping member, the beam member, and the fastening member include portions or regions of a single integral part, or that a single "member" is comprised of two or more elements or parts assembled to provide the member. In relation to FIG. 3, for example, the second end 1123 of the beam member 1118 is integral with the gripping member 1106.

As further shown in FIG. 25, a portion of beam member 1118 within the inner bore 1114 is spaced away from an inner surface 1127 of the wall of the gripping member 106. Beam member 1118 is made of a material having elastic properties such as, for example, a plastic such as ABS. The propensity of beam member 1118 to move in response to an applied force may be adjusted by including a resilient material, such as a plastic or a rubber material, in all or a portion of the space 1114 between the beam member 1118 and the ribbed wall 1112. Also, as shown in FIG. 25, annular shoulder 1130 of first end 1120 of the beam member 1118 opposes and is spaced apart from wall 1112 of the gripping member 1106, and the remainder of first end 1120 extends beyond the gripping member 1106. As will be understood from FIG. 25, the range of deflection of the beam member 1118 relative to the gripping member 1106, indicated by the curved arrows D-D, is limited by the width of the gap provided between shoulder 1130 and the inner wall 1127.

As with certain embodiments above, given that first end 1120 of beam member 1118 is connected to the powered apparatus by fastening member 1122, vibrations generated, for example, by the motor of the powered apparatus will be transmitted to handle 1000 and to the operator's hand. An objective of the present disclosure is to reduce the vibration experienced in this way by the operator. In that regard, a characteristic of the handle 1000 is that handle 1000 may be "tuned" so as to have predetermined natural or standing frequencies, or "modes", of vibration.

Figure 27:
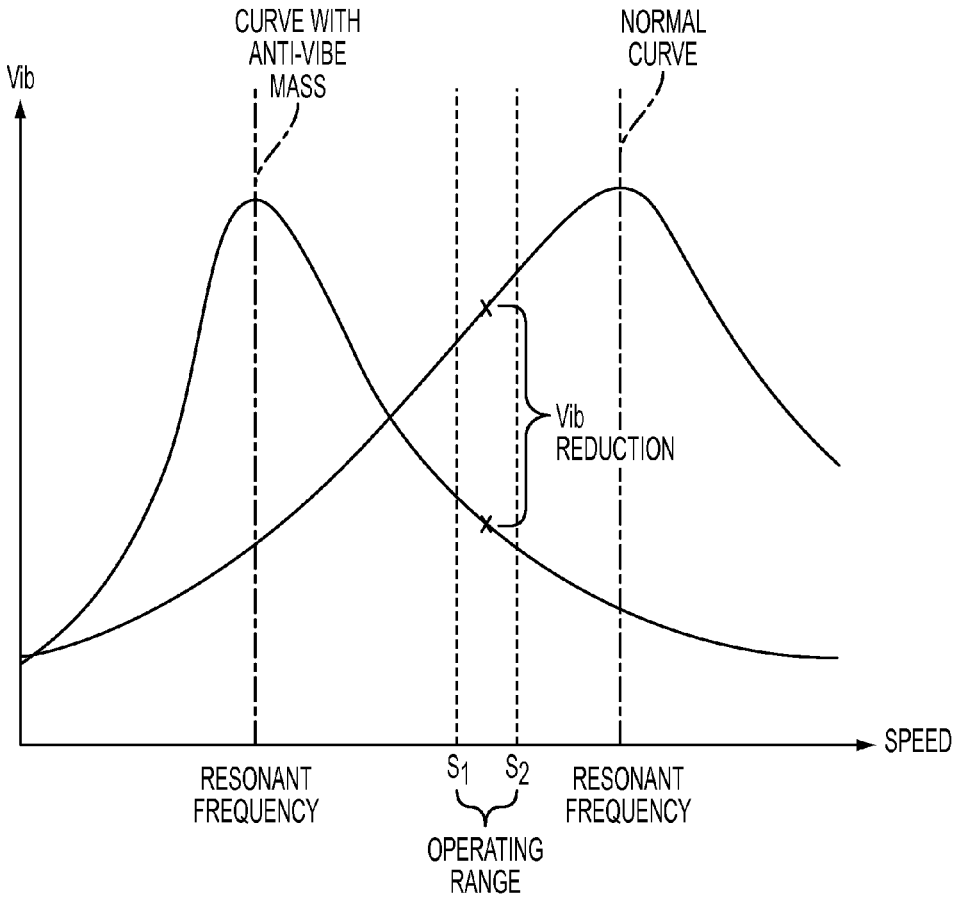
FIG. 27 illustrates a graph showing a vibration reducing shift in the vibration vs. speed curve.

FIG. 27 shows a graph or plot of a unit of vibration experienced by the handle vs. or as a function of operating speed of the power apparatus. A first plot labeled regular or normal (handle which does not have a significant mass toward the cantilevered end) generally shows that the vibration experienced by a normal handle begins at a non-zero amount and increases to a very large amount at resonant frequency which corresponds to a particular tool operating speed. Vibration then drops of as operating speed increases. The present invention seeks to minimize the vibration experienced at a predetermined operating speed by tuning the handle which effectively shifts the graph to the left as shown in FIG. 27. A shifting of the graph to the left results in a lower intersection of the vibration curve with the power apparatus target operating speed.

Leftward shifting of the curve is characterized by manipulating the equation, frequency=sqrt(k/m) or frequency of vibration of the cantilevered member is equal to the square root of the ratio of beam stiffness and mass. Frequency can then be tuned or reduced by lessening the beam stiffness characteristics and/or increasing the beam mass characteristics.

With respect to mass, the modes of vibration of beam member 1118 may be affected by adjusting the weight and position of mass 1116. With regard to stiffness, the modes of vibration of beam member 1118 may be affected by: (1) adjusting the shape (for example, circular cross-section, square cross-section, or beam with ribs) and dimensions (length, diameter, width) of beam member 1118; and (2) the material from which the beam member 1118 is constructed. The stiffness characteristics of the member 1118 are affected by, for example, material of construction, beam length, and beam member wall thickness (if the beam is hollow) or beam member diameter (if the beam is solid).

Although the foregoing description has necessarily presented a limited number of embodiments of the invention, those of ordinary skill in the relevant art will appreciate that various changes in the compositions and other details of the examples that have been described and illustrated herein in order to explain the nature of the invention may be made by those skilled in the art, and all such modifications will remain within the principle and scope of the invention as expressed herein and in the appended claims. It will also be appreciated by those skilled in the art that changes could be made to the embodiments above without departing from the broad inventive concept thereof. It is understood, therefore, that this invention is not limited to the particular embodiments disclosed, but it is intended to cover modifications that are within the principle and scope of the invention, as defined by the claims.

The invention claimed is:

1. A vibration dampening handle for a powered apparatus, the handle comprising: an elongated elastic beam member having a first end secured to the powered apparatus and a second end that is opposite to and extends away from the powered apparatus, the elongated elastic beam further including a longitudinal axis passing through the first and second ends; an elongated gripping member having a first end one of fixedly attached to and integral with the second end of the elongated elastic beam wherein at least a portion of the beam member is stationary relative to the gripping member; the elongated gripping member further including a second end opposite the first end, and including a wall defining an inner bore and having an inner surface, the inner bore extending along the longitudinal axis at least partially through the gripping member and opening on at least the second end of the gripping member; a mass disposed at the second end of the gripping member, wherein the density of the mass is greater than a density of a material from which the gripping member is made; the beam member extending along a region of the longitudinal axis and including a portion within the inner bore and spaced apart from the inner surface, wherein the second end of the gripping member is cantilevered with respect to the second end of the beam member and is movable relative to the first end of the beam member.

2. The vibration dampening handle of claim 1, wherein the mass is metallic.

3. The vibration dampening handle of claim 1, wherein the mass is doughnut shaped.

4. The vibration dampening handle of claim 1, wherein the weight of the second cantilevered end of the gripping member is greater than the first fixed end of the gripping member.

5. The vibration dampening handle of claim 1, wherein the beam is made of a plastic material.

6. The vibration dampening handle of claim 1, wherein the inner wall of the inner bore is ribbed.

* * * * *